US008303229B2

(12) United States Patent
Sunada et al.

(10) Patent No.: US 8,303,229 B2
(45) Date of Patent: Nov. 6, 2012

(54) BOOKBINDING APPARATUS, IMAGE FORMING APPARATUS, AND CONTROL METHOD

(75) Inventors: Hidenori Sunada, Abiko (JP); Mitsuhiko Sato, Kashiwa (JP)

(73) Assignee: Canon Kabushiki Kaisha (JP)

( * ) Notice: Subject to any disclaimer, the term of this patent is extended or adjusted under 35 U.S.C. 154(b) by 574 days.

(21) Appl. No.: 12/484,646

(22) Filed: Jun. 15, 2009

(65) Prior Publication Data

US 2009/0311023 A1 Dec. 17, 2009

(30) Foreign Application Priority Data

Jun. 16, 2008 (JP) ..... 2008-156718

(51) Int. Cl.

| | |
|---|---|
| ***B42C 11/00*** | (2006.01) |
| ***B42C 9/00*** | (2006.01) |
| ***B42C 13/00*** | (2006.01) |
| ***B42C 11/02*** | (2006.01) |
| ***B42C 11/04*** | (2006.01) |
| ***B42B 9/00*** | (2006.01) |
| ***G03G 15/00*** | (2006.01) |

(52) U.S. Cl. ..... 412/11; 412/4; 412/5; 412/8; 412/19; 412/20; 412/21; 412/37; 399/408

(58) Field of Classification Search ..... 412/4–5, 412/8, 11, 13, 19–21, 37; 399/408
See application file for complete search history.

(56) References Cited

U.S. PATENT DOCUMENTS

| | | | | |
|---|---|---|---|---|
| 7,568,510 | B2 * | 8/2009 | Nagaya et al. | 412/37 |
| 8,019,270 | B2 * | 9/2011 | Fujii et al. | 399/408 |
| 2007/0085256 | A1 * | 4/2007 | Miyake et al. | 412/8 |
| 2007/0086876 | A1 * | 4/2007 | Sanmiya et al. | 412/8 |
| 2009/0067950 | A1 * | 3/2009 | Ueda | 412/11 |

FOREIGN PATENT DOCUMENTS

JP 2007-044821 A 2/2007

* cited by examiner

*Primary Examiner* — Dana Ross
*Assistant Examiner* — Kyle Grabowski
(74) *Attorney, Agent, or Firm* — Rossi, Kimms & McDowell LLP

(57) ABSTRACT

A bookbinding apparatus which makes it possible to shorten a time period required to heat an adhesive when the power of the bookbinding apparatus is turned on again. A glue preparation section heats glue. A glue applying section applies the heated glue to a recording sheet bundle. A CPU of the bookbinding apparatus determines at the power-on of the apparatus whether or not there is a recording sheet bundle to which glue is to be applied within the apparatus. When there is no such recording sheet bundle, the glue applying section applies glue to a recording sheet bundle after the temperature of the glue has reached a first target temperature, whereas when there is such a recording sheet bundle, the glue applying section applies the glue to the recording sheet bundle after the glue temperature has reached a second target temperature lower than the first target temperature.

9 Claims, 13 Drawing Sheets

BOOKBINDING APPARATUS, IMAGE FORMING APPARATUS, AND CONTROL METHOD

BACKGROUND OF THE INVENTION

1. Field of the Invention

The present invention relates to a bookbinding apparatus for binding recording sheets having images formed thereon by an image forming apparatus and discharged therefrom, into a book, the image forming apparatus, and a control method.

2. Description of the Related Art

Conventionally, an image forming system has come into wide use which is comprised of an image forming apparatus and a post-processing unit, and is configured to be capable of performing image forming processing and subsequent post processing on recording sheets. In an image forming system of this type, images are formed on recording sheets based on digital image data, and then the recording sheets are conveyed into a post-processing unit, followed by being subjected to post processing (stapling, punching, folding, etc.) online.

Further, in recent years, there has come on the market an image forming system having an image forming apparatus connected to a case binding machine that performs case binding by applying glue to one side of a recording sheet bundle as a main body of printed matter, bonding a cover sheet to the glue-applied side of the recording sheet bundle, and then cutting the other three sides of the recording sheet bundle covered by the cover sheet.

In a case where a case binding operation is performed by a case binding machine, a recording sheet bundle is shifted within the machine in accordance with the progress of the operation. The case binding machine includes a processing section having a complicated mechanism for applying glue to a recording sheet bundle, cutting the same and so forth, and hence even after the power of the machine is turned off, it is difficult for an operator to put his/her hand into the processing section. This makes it impossible for the operator to handle the recording sheet bundle until it is discharged as a product after going through the case binding process.

To eliminate this inconvenience, there has been proposed a method of discharging a recording sheet bundle from a case binding machine (see e.g. US Patent Publication No. 2007/0085256). In the method disclosed in US Patent Publication No. 2007/0085256, when preparation of a cover sheet fails before a step of sticking the cover sheet to a recording sheet bundle, a cancellation process is executed in which only processing for applying glue to the side of a recording sheet bundle is performed without sticking the cover sheet to the recording sheet bundle and then the recording sheet bundle is discharged after drying the glue.

On the other hand, there has been proposed a method of processing to be executed when the power of a case binding machine is turned on again after turn-off of the power (see e.g. Japanese Patent Laid-Open Publication No. 2007-44821). In the method disclosed in Japanese Patent Laid-Open Publication No. 2007-44821, information on the progress of cutting processing in a step of cutting a recording sheet bundle is stored in a memory, and when the power of the case binding machine is turned on again after turn-off of the power due to a power failure or for troubleshooting a sheet jam or the like, the continuation of the cutting step is carried out based on the information on the progress of the cutting processing stored in the memory.

A conventional case binding machine of the above-mentioned type suffers from the following problems: When the power of the case binding machine is turned off due to occurrence of a trouble immediately before glue is applied to a recording sheet bundle, the recording sheet bundle which is to be glued remains in the machine. In the meantime, heated glue prepared for the recording sheet bundle is cooled. For this reason, when the power of the case binding machine is turned on, preparation for glue application is restarted so as to apply glue to the recording sheet bundle remaining in the machine and then discharge the same.

In this case, the recording sheet bundle remaining in the machine has no cover sheet stuck thereto, and hence the recording sheet bundle cannot be a product. Therefore, the recording sheet bundle remaining in the machine is discharged as a defective product, and it is a waste of time to execute the same preparation for a glue application as in the case of a normal binding operation for a recording sheet bundle discharged as a product. Further, depending on the arrangement of a case binding machine, it is sometimes impossible to convey recording sheets from the image forming apparatus to a post-processing apparatus other than the case binding machine until the gluing of the recording sheet bundle is completed. In such a case, not only the case binding operation but also operations for the other post processing cannot be executed.

SUMMARY OF THE INVENTION

The present invention makes it possible to shorten a time period required to heat an adhesive when the power of a bookbinding apparatus is turned on again after power-off of the same before application of an adhesive to a recording sheet bundle, to thereby reduce a time period taken before completion of discharge of the recording sheet bundle.

In a first aspect of the present invention, there is provided a bookbinding apparatus for performing bookbinding processing by applying an adhesive to an end of a recording sheet bundle and sticking a cover sheet to the end of the recording sheet bundle, comprising a heating unit configured to heat the adhesive, a temperature detecting unit configured to detect a temperature of the adhesive, an adhesive applying unit configured to apply the adhesive heated by the heating unit to the end of the recording sheet bundle, a determination unit configured to determine at power-on of the bookbinding apparatus whether or not there is a recording sheet bundle to which the adhesive has not been applied within the bookbinding apparatus, and a control unit configured to be operable when the determination unit determines at the power-on of the bookbinding apparatus that there is not the recording sheet bundle to which the adhesive has not been applied within the bookbinding apparatus, to cause the adhesive applying unit to apply the adhesive to a recording sheet bundle after the temperature detecting unit detects that the temperature of the adhesive has reached a first temperature, and when the determination unit determines at the power-on of the bookbinding apparatus that there is the recording sheet bundle to which the adhesive has not been applied within the bookbinding apparatus, to cause the adhesive applying unit to apply the adhesive to the recording sheet bundle after the temperature detecting unit detects that the temperature of the adhesive has reached a second temperature lower than the first temperature.

In a second aspect of the present invention, there is provided an image forming apparatus connected to a bookbinding apparatus to deliver a recording sheet having an image formed thereon to the bookbinding apparatus, wherein the bookbinding apparatus comprises a heating unit configured to heat an adhesive, a temperature detecting unit configured to detect a temperature of the adhesive, an adhesive applying unit configured to apply the adhesive heated by the heating unit to an end of the recording sheet bundle, a determination unit configured to determine at power-on of the bookbinding apparatus whether or not there is a recording sheet bundle to which the adhesive has not been applied within the bookbinding apparatus, and a control unit configured to be operable when the determination unit determines at the power-on of the bookbinding apparatus that there is not any recording sheet bundle to which the adhesive has not been applied within the bookbinding apparatus, to cause the adhesive applying unit to apply the adhesive to a recording sheet bundle after the temperature detecting unit detects that the temperature of the adhesive has reached a first temperature, and when the determination unit determines at the power-on of the bookbinding apparatus that there is a recording sheet bundle to which the adhesive has not been applied within the bookbinding apparatus, to cause the adhesive applying unit to apply the adhesive to the recording sheet bundle after the temperature detecting unit detects that the temperature of the adhesive has reached a second temperature lower than the first temperature.

In a third aspect of the present invention, there is provided a method of controlling a bookbinding apparatus for performing bookbinding processing by applying an adhesive to an end of a recording sheet bundle and sticking a cover sheet to the end of the recording sheet bundle, wherein when there is not any recording sheet bundle to which the adhesive has not been applied within the bookbinding apparatus, the adhesive is heated, and after the temperature of the adhesive has reached a first temperature, the adhesive is caused to be applied to the recording sheet bundle, and wherein when there is a recording sheet bundle to which the adhesive has not been applied within the bookbinding apparatus, the adhesive is heated, and after the temperature of the adhesive has reached a second temperature lower than the first temperature, the adhesive is caused to be applied to the recording sheet bundle.

In a fourth aspect of the present invention, there is provided a bookbinding apparatus for performing bookbinding processing by applying an adhesive to an end of a recording sheet bundle and sticking a cover sheet to the end of the recording sheet bundle, comprising a heating unit configured to heat the adhesive, a temperature detecting unit configured to detect a temperature of the adhesive, an adhesive applying unit configured to apply the adhesive heated by the heating unit to the end of the recording sheet bundle, a determination unit configured to determine at power-on of the bookbinding apparatus whether or not there is the recording sheet bundle to which the adhesive has not been applied within the bookbinding apparatus, and a control unit configured to be operable when the determination unit determines at the power-on of the bookbinding apparatus that there is the recording sheet bundle to which the adhesive has not been applied within the bookbinding apparatus, to perform predetermined control such that a time period taken to apply the adhesive to the recording sheet bundle and discharge the recording sheet bundle from the bookbinding apparatus is made shorter than in a bookbinding operation at power-on of the bookbinding apparatus when there is not the recording sheet bundle.

In a fifth aspect of the present invention, there is provided a bookbinding apparatus for performing bookbinding processing by applying an adhesive to an end of a recording sheet bundle and sticking a cover sheet to the end of the recording sheet bundle, comprising a heating unit configured to heat the adhesive, a temperature detecting unit configured to detect a temperature of the adhesive, an adhesive applying unit configured to apply the adhesive heated by the heating unit to the end of the recording sheet bundle, a determination unit configured to determine at power-on of the bookbinding apparatus whether or not there is a recording sheet bundle for which the bookbinding processing is not completed and to which the adhesive has not been applied, and a control unit configured to be operable when the determination unit determines at the power-on of the bookbinding apparatus that there is not the recording sheet bundle for which the bookbinding processing is not completed and to which the adhesive has not been applied, to cause the adhesive applying unit to apply the adhesive to a recording sheet bundle after the temperature detecting unit detects that the temperature of the adhesive has reached a first temperature, and when the determination unit determines at the power-on of the bookbinding apparatus that there is the recording sheet bundle for which the bookbinding processing is not completed and to which the adhesive has not been applied, to cause the adhesive applying unit to apply the adhesive to the recording sheet bundle after the temperature detecting unit detects that the temperature of the adhesive has reached a second temperature lower than the first temperature.

In a sixth aspect of the present invention, there is provided an image forming apparatus connected to a bookbinding apparatus to deliver a recording sheet having an image formed thereon to the bookbinding apparatus, wherein the bookbinding apparatus comprises a heating unit configured to heat the adhesive, a temperature detecting unit configured to detect a temperature of the adhesive, an adhesive applying unit configured to apply the adhesive heated by the heating unit to an end of the recording sheet bundle, a determination unit configured to determine at power-on of the bookbinding apparatus whether or not there is a recording sheet bundle for which the bookbinding processing is not completed and to which the adhesive has not been applied, and a control unit configured to be operable when the determination unit determines at the power-on of the bookbinding apparatus that there is not any recording sheet bundle for which the bookbinding processing is not completed and to which the adhesive has not been applied, to cause the adhesive applying unit to apply the adhesive to a recording sheet bundle after the temperature detecting unit detects that the temperature of the adhesive has reached a first temperature, and when the determination unit determines at the power-on of the bookbinding apparatus that there is a recording sheet bundle for which the bookbinding processing is not completed and to which the adhesive has not been applied, to cause the adhesive applying unit to apply the adhesive to the recording sheet bundle after the temperature detecting unit detects that the temperature of the adhesive has reached a second temperature lower than the first temperature.

In a seventh aspect of the present invention, there is provided a method of controlling a bookbinding apparatus for performing bookbinding processing by applying an adhesive to an end of a recording sheet bundle and sticking a cover sheet to the end of the recording sheet bundle, wherein when there is not any recording sheet bundle for which the bookbinding processing is not completed and to which the adhesive has not been applied, the adhesive is heated, and after the temperature of the adhesive has reached a first temperature, the adhesive is caused to be applied to the recording sheet bundle, and wherein when there is a recording sheet bundle for which the bookbinding processing is not completed and to which the adhesive has not been applied, the adhesive is heated, and after the temperature of the adhesive has reached a second temperature lower than the first temperature, the adhesive is caused to be applied to the recording sheet bundle.

In an eighth aspect of the present invention, there is provided a bookbinding apparatus for performing bookbinding processing by applying an adhesive to an end of a recording sheet bundle and sticking a cover sheet to the end of the recording sheet bundle, comprising a heating unit configured to heat the adhesive, a temperature detecting unit configured to detect a temperature of the adhesive, an adhesive applying unit configured to apply the adhesive heated by the heating unit to the end of the recording sheet bundle, a determination unit configured to determine at power-on of the bookbinding apparatus whether or not there is the recording sheet bundle for which the bookbinding processing is not completed and to which the adhesive has not been applied, and a control unit configured to be operable when the determination unit determines at the power-on of the bookbinding apparatus that there is the recording sheet bundle for which the bookbinding processing is not completed and to which the adhesive has not been applied, to perform predetermined control such that a time period taken to apply the adhesive to the recording sheet bundle and discharge the recording sheet bundle from the bookbinding apparatus is made shorter than in a bookbinding operation at power-on of the bookbinding apparatus there is not the recording sheet bundle.

According to the present invention, when there is a recording sheet bundle to which the adhesive has not been applied within the bookbinding apparatus at the power-on of the same, the adhesive is applied to the recording sheet bundle after the adhesive temperature detected by the temperature detecting unit reaches the second temperature lower than the first temperature set for normal application of the adhesive. This makes it possible to shorten a time period required to heat the adhesive when the power of the bookbinding apparatus is turned on again after power-off of the same before application of the adhesive to a recording sheet bundle. As a consequence, when there remains a recording sheet bundle to which the adhesive has not been applied in the bookbinding apparatus at the power-on of the bookbinding apparatus, it is possible to shorten a time period taken before completion of discharge of the recording sheet bundle.

The features and advantages of the invention will become more apparent from the following detailed description taken in conjunction with the accompanying drawings.

DETAILED DESCRIPTION OF THE EMBODIMENTS

The present invention will now be described in detail below with reference to the accompanying drawings showing an embodiment thereof.

Figure 1:
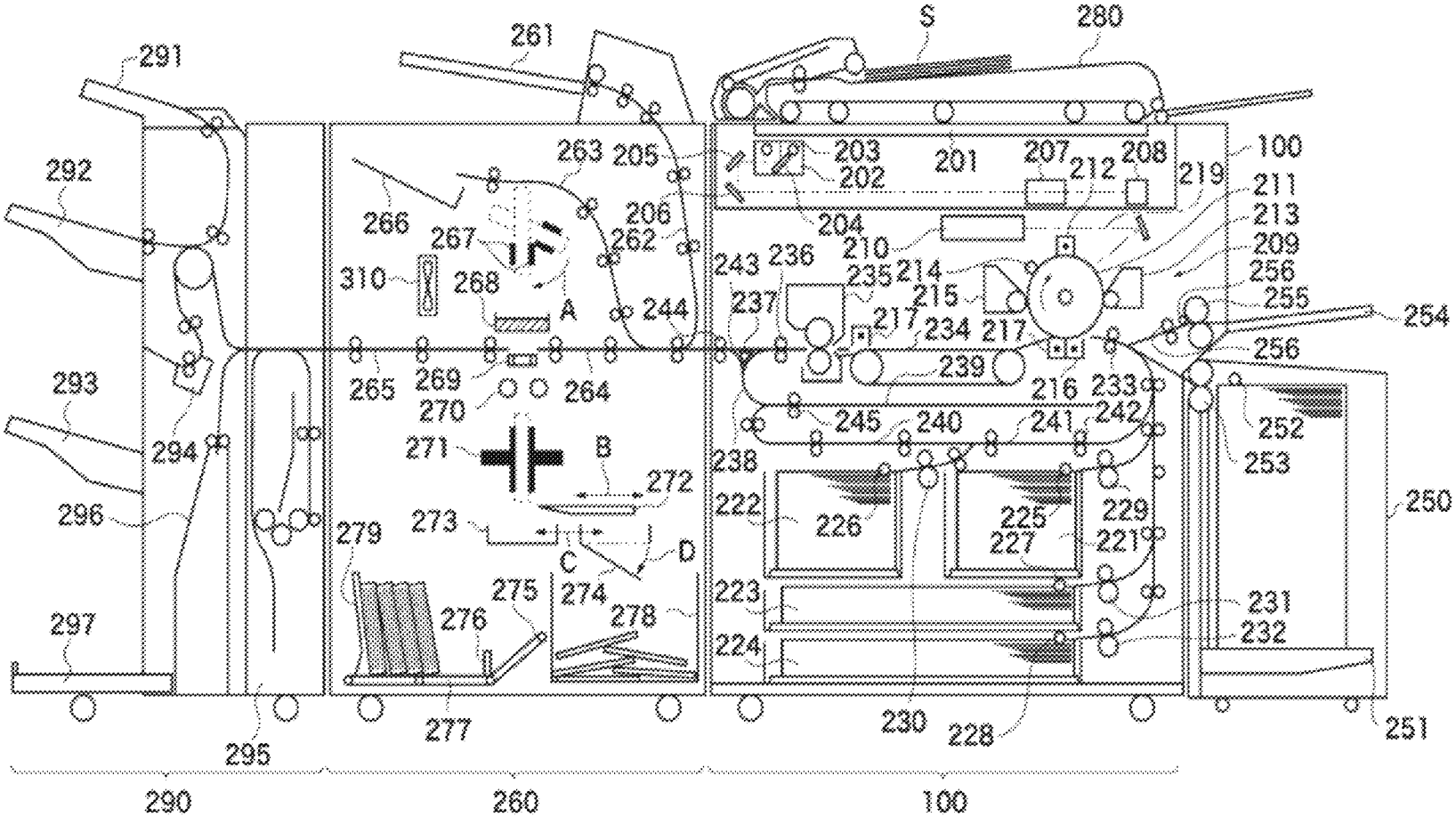
FIG. 1 is a schematic view of a digital copying system according to an embodiment of the present invention.

FIG. 1 is a schematic view of a digital copying system according to an embodiment of the present invention.

As shown in FIG. 1, the digital copying system is comprised of a digital copying machine 100 (image forming apparatus), a case binding machine 260 (bookbinding apparatus), and a finisher 290. The digital copying machine 100 has a deck 250 and an automatic document feeder (ADF) 280 attached thereto. The deck 250 contains numerous recording sheets. The automatic document feeder 280 feeds originals S stacked on a tray, one by one, onto an original platen glass 201 and sequentially discharges the originals S onto a discharge tray after completion of reading of each original. An operator (user) can select one of moving original reading for reading an original while conveying the same and stationary original reading for reading an original placed on the original platen glass 201.

A scanner 202 of the digital copying machine 100 is provided with an original illuminating lamp 203 and a scanning mirror 204. The scanner 202 is driven by a motor, not shown, to reciprocate for scanning in a predetermined direction, and illuminates each original using the original illuminating lamp 203. A reflected light from the original passes through a lens 207 via the scanning mirror 204 and scanning mirrors 205 and 206 to form an image on a CCD sensor provided in an image sensor unit 208. The image sensor unit 208 performs image processing by converting the reflected light from the original into an electric signal, and outputs a generated image signal.

An exposure controller 210 is comprised of a laser emitter, a polygon scanner, and so forth, none of which are shown. The exposure controller 210 irradiates a photosensitive drum 211 with a laser beam 219 modulated based on the image signal output from the image sensor unit 208. Around the photosensitive drum 211, there are arranged an image forming unit 209 (comprised of a primary electrostatic charger 212, a development device 213, a transfer roller 216 including a transfer charger, a separation charger 217, and a pre-exposure lamp 214) and a cleaning unit 215. The photosensitive drum 211 is driven by a motor, not shown, in a direction indicted by an arrow, and charged to a predetermined potential by the primary electrostatic charger 212, whereafter the laser beam 219 is irradiated onto the photosensitive drum 211 to form an electrostatic latent image on the same. The development device 213 develops the electrostatic latent image on the photosensitive drum 211 by toner, whereby the electrostatic latent image is visualized as a toner image.

On the other hand, recording sheets are fed one by one from one of a right cassette deck 221, a left cassette deck 222, an upper cassette 223, a lower cassette 224, and the deck 250 by an associated one of pickup rollers (225, 226, 227, 228, and 252). Each recording sheet is conveyed into a conveying path by an associated one of sheet feed rollers (229, 230, 231, 232, and 253). Thereafter, the recording sheet is conveyed to a transfer section by a registration roller 233, where the toner image formed on the photosensitive drum 211 is transferred onto the recording sheet by the transfer roller 216. After completion of the transfer of the toner image, residual toner is cleaned from the photosensitive drum 211 by the cleaning unit 215, and residual charge on the photosensitive drum 211 is erased by the pre-exposure lamp 214.

The deck 250 is capable of containing e.g. 3500 recording sheets. The deck 250 has a lifter 251 which moves upward according to the amount of recording sheets to constantly hold a top of the recording sheets in contact with the pickup roller 252. A recording sheet fed from the deck 250 is conveyed by the sheet feed roller 253 into the conveying path in the digital copying machine 100, and is then conveyed to the transfer section via the registration roller 233. It should be noted that in the case of manual sheet feed, a recording sheet is fed from a multi-sheet manual feeder 254 which is capable of containing e.g. 50 recording sheets, and is conveyed by a feed roller 255 and a conveying roller 256 to the transfer section via the registration roller 233.

After completion of the transfer in the transfer section, the recording sheet is separated from the photosensitive drum 211 by a separation charger 217, and is then conveyed to a fixing device 235 by a conveyor belt 234. The recording sheet is pressed and heated by the fixing device 235, whereby toner on the recording sheet is fixed. In the case of one-sided recording (one-sided copying), a recording sheet having toner fixed thereon is delivered by an inner discharge roller 236 and a discharge roller 244 via a discharge path 243 to the case binding machine 260 connected to the digital copying machine 100.

A discharge flapper 237 switches the recording sheet conveying path between a conveying path 238 and the discharge path 243. A recording sheet delivered by the inner discharge roller 236 and guided into the conveying path 238 by the discharge flapper 237 is inverted by an inversion path 239 and is then guided into a sheet re-feed path 241 via a lower conveying path 240. A recording sheet fed from the left cassette deck 222 by the sheet feed roller 230 is also guided into the re-feed path 241. A sheet re-feed roller 242 re-feeds the recording sheet to the transfer section. The discharge roller 244 is disposed in the vicinity of the discharge flapper 237 to discharge a recording sheet guided into the discharge path 243 by the discharge flapper 237, out of the digital copying machine 100.

In the case of double-sided recording (double-sided copying), the discharge flapper 237 is held up, whereby a recording sheet having an image formed thereon is guided into the re-feed path 241 via the inversion path 239 and the lower conveying path 240. In this case, the recording sheet is conveyed into the inversion path 239 by an inverting roller 245 until the trailing end thereof enters the inversion path 239, and then the inverting roller 245 is reversely rotated, whereby the recording sheet is conveyed into the lower conveying path 240. In the case of discharging a recording sheet from the digital copying machine 100 after inverting the same, the discharge flapper 237 is lifted up, and the sheet is conveyed into the inversion path 239 by the inverting roller 245 until just before the trailing end of the recording sheet completely enters the inversion path 239. Then, the inverting roller 245 is reversely rotated, whereby the recording sheet is conveyed toward the discharge roller 244 after being inverted.

The case binding machine 260 and the finisher 290 are post-processing units for aligning and binding recording sheets discharged from the digital copying machine 100. The case binding machine 260 has a bookbinding function for aligning a plurality of recording sheets each having an image formed thereon by the digital copying machine 100 to form a recording sheet bundle for the main-body in bookbinding (hereinafter referred to as "main-body recording sheets bundle"), applying glue to one end of the recording sheet bundle, and sticking a cover sheet to the end. The finisher 290 has a function for performing various types of post processing (alignment, stapling, Z folding, and double folding) on recording sheets each having an image formed thereon by the digital copying machine 100. The case binding machine 260 and the finisher 290 will be described in more detail hereinafter.

Figure 2:
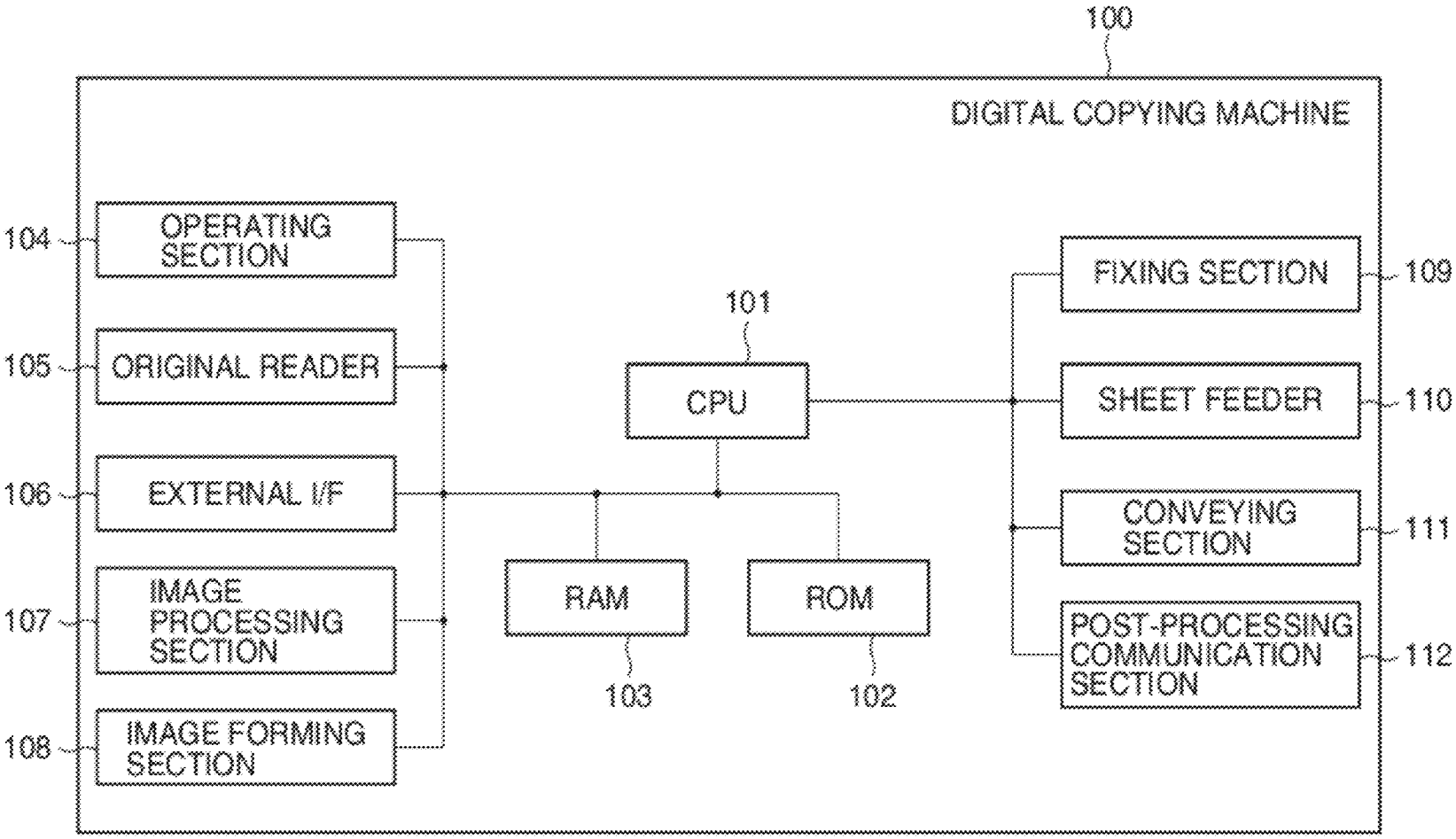
FIG. 2 is a functional block diagram of a digital copying machine included in the digital copying system.

FIG. 2 is a functional block diagram of the digital copying machine 100 included in the digital copying system.

As shown in FIG. 2, the digital copying machine 100 includes a CPU 101, a ROM 102, a RAM 103, an operating section 104, an original reader 105, and an external interface (I/F) 106. Further, the digital copying machine 100 includes an image processing section 107, an image forming section 108, a fixing section 109, a sheet feeder 110, a sheet conveying section 111, and a post-processing communication section 112.

The CPU 101 controls the overall operation of the digital copying machine 100. The ROM 102 stores control contents (including programs) to be executed by the CPU 101. The RAM 103 provides a work area required by the CPU 101 for controlling the digital copying machine 100. Further, the RAM 103 provides an area for storing digital image data obtained by reading an original by the original reader 105 and digital image data and the like externally received via the external interface 106. The RAM 103 also provides a work area used by the image processing section 107 for carrying out image processing on digital image data obtained from the original reader 105 or via the external interface 106.

The operating section 104 is used by the user so as to set a copy job which the user desires to cause the digital copying machine 100 to execute. It is also possible to use an external apparatus to cause the digital copying machine 100 to execute a print job, via the external interface 106. The original reader 105 reads an image from an original placed on the original platen glass of the digital copying machine 100, converts image data read from the original into digital image data, according to settings configured via the operating section 104, and then stores the digital image data in the RAM 103.

The external interface 106 is connected to a network using e.g. TCP/IP. The external interface 106 is capable of receiving an instruction for executing a print job, from a computer connected to the network, or sending information stored in the digital copying machine 100 to the computer.

The image processing section 107 performs necessary image processing on obtained digital image data according to copy job settings, such as one-sided printing or double-sided printing and enlargement or reduction, configured via the operating section 104, or the contents of an image read from an original by the original reader 105. Further, the image processing section 107 stores digital image data to be processed for image formation in the RAM 103.

The image forming section 108 has the primary electrostatic charger 212, the development device 213, the transfer roller 216, the pre-exposure lamp 214, and the photosensitive drum 211, appearing in FIG. 1, thereof operated under the control of the CPU 101, to form an image on a recording sheet. The fixing section 109 has the fixing device 235, appearing in FIG. 1, thereof operated under the control of the CPU 101, to fix toner on a recording sheet. The sheet feeder 110 feeds recording sheets from a selected one of the cassette decks, appearing in FIG. 1, by an associated pickup roller and an associated sheet feed roller, under the control of the CPU 101. The sheet conveying section 111 drives the conveying roller and the conveyor belt, appearing in FIG. 1, under the control of the CPU 101, to convey recording sheets.

After toner image transfer and fixing on one or two surfaces of a recoding sheet has been performed as described above, the CPU 101 issues an instruction for post processing (bookbinding, stapling, punching, etc.) to the case binding machine 260 or the finisher 290 via the post-processing communication section 112 (see FIG. 2).

Figure 3:
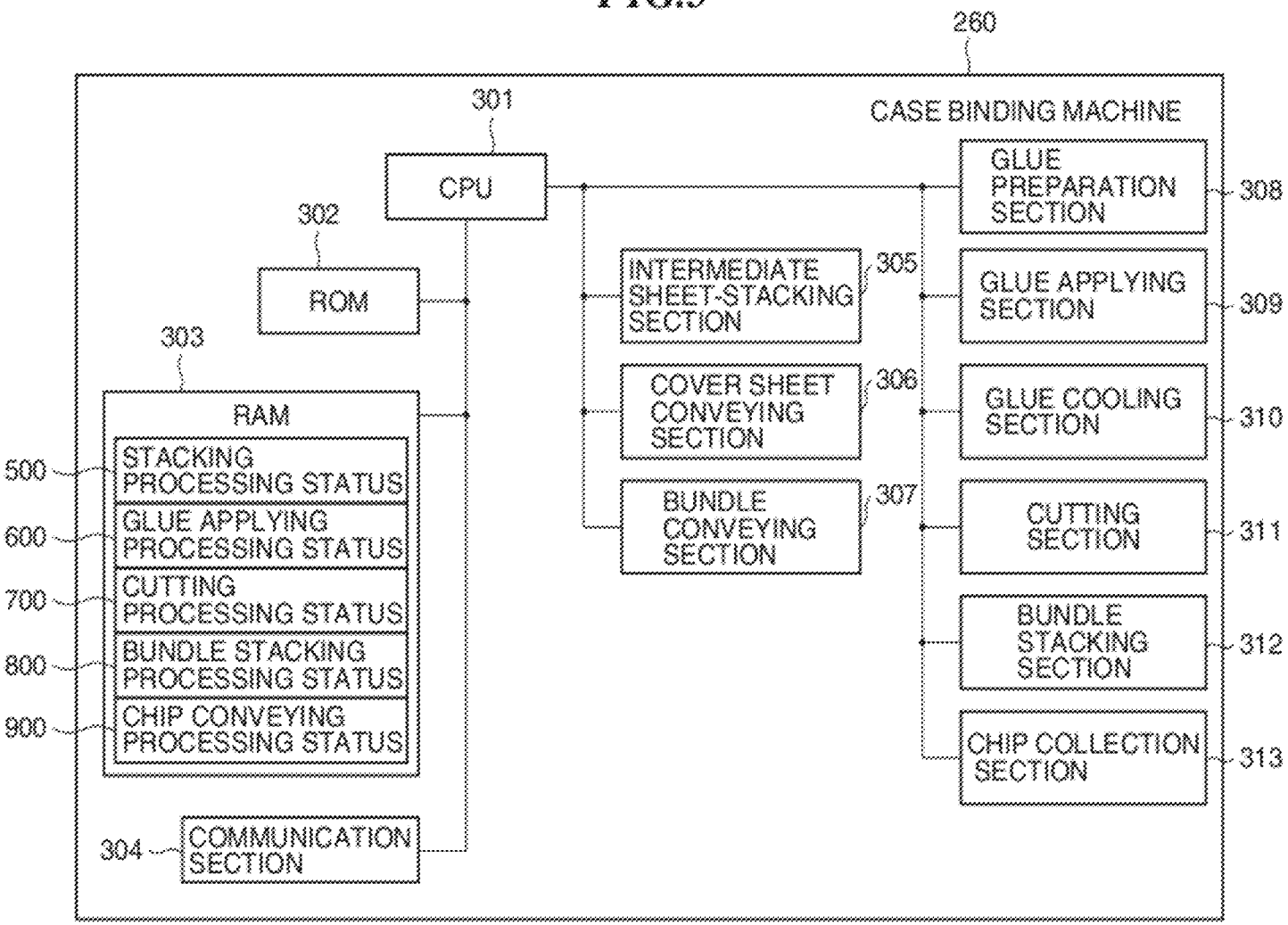
FIG. 3 is a functional block diagram of a case binding machine included in the digital copying system.

FIG. 3 is a functional block diagram of the case binding machine included in the digital copying system.

As shown in FIG. 3, the case binding machine 260 includes a CPU 301, a ROM 302, a RAM 303, a communication section 304, an intermediate sheet-stacking section 305, a cover sheet conveying section 306, and a bundle conveying section 307. Further, the case binding machine 260 includes a glue preparation section 308, a glue applying section 309, a glue cooling section 310, a cutting section 311, a bundle stacking section 312, and a chip collector section 313.

The CPU 301 controls the overall operation of the case binding machine 260. The CPU 301 executes processes shown in respective flowcharts in FIGS. 5 to 9, 12, 13A, and 13B. The ROM 302 stores control contents (including programs) to be executed by the CPU 301. The RAM 303 provides a work area required by the CPU 301 for controlling the case binding machine.

Further, the RAM 303 stores a value indicative of the current operational status (progress) of each of stacking processing, glue application processing, cutting processing, bundle stacking processing, and chip conveying processing for achieving case binding. The values indicative of the respective current operational statuses are shown in FIG. 3 as a stacking processing status 500, a glue application processing status 600, a cutting processing status 700, a bundle stacking processing status 800, and a chip conveying processing status 900. It should be noted that the RAM 303 is backed up by a battery to store the processing statuses even after the power of the case binding machine 260 is turned off.

The communication section 304 controls communication between the digital copying machine 100 and the finisher 290. The communication section 304 receives instructions (details of processing of recording sheets) issued from the post-processing section 112 of the digital copying machine 100, and exchanges information required for conveyance of recording sheets with the finisher 290.

The intermediate sheet-stacking section 305 accumulates and aligns recording sheets to form the main-body recording sheet bundle, and functions as a stacking unit of the present invention, for stacking a recording sheet bundle to which an adhesive (glue in the present embodiment) is to be applied. The intermediate sheet-stacking section 305 includes an alignment member (not shown) for aligning main-body recording sheets on an intermediate sheet stacking tray 266 appearing in FIG. 1. The cover sheet conveying section 306 conveys a recording sheet to be used as a cover sheet in bookbinding. The cover sheet conveying section 306 includes cover sheet paths 264 and 265 appearing in FIG. 1, a conveying roller (not shown), and a conveying roller drive motor (not shown).

The bundle conveying section 307 conveys the main-body recording sheet bundle aligned by the intermediate sheet-stacking section 305 to the glue applying section 309, and further conveys the recording sheet bundle having a cover sheet stuck thereto by the glue applying section 309 to the bundle stacking section 312 via the cutting section 311. The bundle conveying section 307 includes a drive section (not shown) for rotating or lowering a gripper 267.

The glue preparation section 308 performs a preparation operation to make glue applicable. The method of preparation will be described in detail hereinafter. The glue preparation section 308 functions as a heating unit of the present invention, for heating glue to be applied to the end of a recording sheet bundle. The glue preparation section 308 includes a heater 1001 for heating glue in a glue container 268 appearing in FIG. 1 and a stirring roller 1002 (see FIG. 10) for stirring the glue.

The glue applying section 309 applies the glue prepared by the glue preparation section 308 to the end of the main-body recording sheet bundle, and sticks the main-body recording sheet bundle to a central part of a cover sheet. The glue applying section 309 functions as an adhesive applying unit of the present invention, for applying glue heated to a predetermined temperature to the end of the recording sheet bundle, and as a cover sheet bonding unit of the present invention, for sticking a cover sheet to the recording sheet bundle having the glue applied thereto. The glue applying section 309 includes the glue container 268 and a drive section (not shown) for moving the glue container 268 in the front-rear direction, as viewed in FIG. 1, of a sheet surface.

It should be noted that the glue in the present embodiment is an adhesive which remains solid in an ambient temperature and melts by being heated.

A determination unit and a control unit of the present invention have functions corresponding to the following operations of the CPU 301 of the case binding machine 260 (bookbinding apparatus): When it is determined at the power-on of the case binding machine that there is no recording sheet bundle to which glue is to be applied, in the machine, the CPU 301 causes the glue preparation section 308 to perform a first preparation operation for heating glue to a first target temperature. On the other hand, when it is determined at the power-on of the case binding machine 260 that there is a recording sheet bundle to which glue is to be applied, in the machine, the CPU 301 causes the glue preparation section 308 to perform a second preparation operation for heating glue to a second target temperature lower than the first target temperature.

Further, based on the operational statuses (including the state of stacking of recording sheets on the intermediate sheet stacking tray 266, and the state of application of glue to the recording sheet bundle) stored in the RAM 303, the CPU 301 determines at the power-on of the case binding machine 260 whether or not there is a recording sheet bundle to which glue is to be applied, in the machine. If it is determined at the power-on of the case binding machine that there is a recording sheet bundle to which glue is to be applied, in the machine, glue is applied to the recording sheet bundle, and then the recording sheet bundle having the glue applied thereto is discharged without having a cover sheet stuck thereto.

Immediately after the recording sheet bundle is glued to the cover sheet in the glue applying section 309, the glue-applied part of the recording sheet bundle is hot and the glue thereon is still molten. Therefore, the recording sheet bundle is cooled in the glue cooling section 310. This cooling is performed not only to prevent attachment of glue in the machine during the subsequent conveyance of the recording sheet bundle, but also to prevent a book having a reduced finish size due to shrinkage of glue, which occurs when the glue is cooled after cutting the still warm recording sheet bundle in the cutting section 311.

In the cutting section 311, the other three sides of the recording sheet bundle than the glue-applied side are cut off. The cutting section 311 includes a drive section (not shown) for rotating a trim gripper 271 appearing in FIG. 1, and a drive section (not shown) for moving a cutter 272. The recording sheet bundle having the three sides thereof cut off is discharged as a product onto the bundle stacking section 312. The bundle stacking section 312 includes a drive section (not shown) for moving a stopper 279, appearing in FIG. 1, on a book stacking tray 277 and a drive section (not shown) for erecting a stacking plate 275.

Portions cut off from the three sides of the recording sheet bundle are thrown away as cut-off chips into a chip waste box 278 (see FIG. 1) by the chip collector section 313 via a chip receiver box 273. The chip collector section 313 includes a drive section (not shown) for moving the chip receiver box 273, appearing in FIG. 1, in directions indicated by an arrow C in FIG. 1 and a drive section (not shown) for opening a chip receiver box bottom plate 274, appearing in FIG. 1, in a direction indicated by an arrow D in FIG. 1.

Next, the arrangement of the case binding machine 260 and a sequence of operations of a bookbinding process executed using the case binding machine 260 will be described with reference to FIGS. 1 and 3.

The CPU 301 of the case binding machine 260 receives instructions concerning the details of post processing for recording sheets discharged from the digital copying machine 100, via the communication section 304. The CPU 301 drives a motor, not shown, to thereby cause the conveying roller to convey a recording sheet discharged from the digital copying machine 100 into an intermediate sheet path 263 or the cover sheet paths 264 and 265 according to the processing details specified for the recording sheet.

Out of recording sheets for use in bookbinding, main-body recording sheets (intermediate sheets in the bookbinding) are stacked on the intermediate sheet stacking tray 266 (stacking unit) via the intermediate sheet path 263. Whenever one main-body recording sheet is stacked on the intermediate sheet stacking tray 266, an alignment pad, not shown, is caused to swing by controlling the intermediate sheet-stacking section 305, whereby stacked main-body recording sheets are aligned in both the front-rear direction of a sheet surface, as viewed in FIG. 1, and the recording sheet conveying direction. The sheet-surface front-rear direction is orthogonal to the recording sheet conveying direction.

On the other hand, a cover sheet is conveyed into the cover sheet paths 264 and 265. When the cover sheet is conveyed, by control of the cover sheet conveying section 306, to a folding unit 269 disposed in facing relation to a space between the cover sheet paths 264 and 265, such that the center of the cover sheet is aligned with the folding unit 269, the conveyance of the cover sheet is stopped. The folding unit 269 is comprised of a vertically movable abutment member 269*a* disposed in a central part of the folding unit 269 and a pair of horizontally movable pressure members 269*b* (see FIG. 4).

On the other hand, when the digital copying machine 100 gives an instruction for delivering a recording sheet to the finisher 290, the CPU 301 controls the cover sheet conveying section 306 to convey the recording sheet through the cover sheet paths 264 and 265 to an inlet of the finisher 290 without stopping the same at the folding unit 269.

When the stacking of main-body recording sheets in the intermediate sheet stacking tray 266 is completed, the bundle conveying section 307 is controlled to grip the main-body recording sheets as a recording sheet bundle by the gripper 267 and rotate the main-body recording sheet bundle in a direction indicated by an arrow A in FIG. 1. Then, the CPU 301 causes the glue applying section 309 to apply glue to the entire lower end surface of the main-body recording sheet bundle by moving the glue container 268 in the sheet-surface front-rear direction, as viewed in FIG. 1, with the glue container 268 held in contact with the lower end of the main-body recording sheet bundle. At this time point, the glue has been made sufficiently molten by the glue preparation section 308, and therefore the glue container 268 containing the molten glue is brought into contact with the lower end of the main-body recording sheet bundle, whereby glue application is completed.

Figure 4:
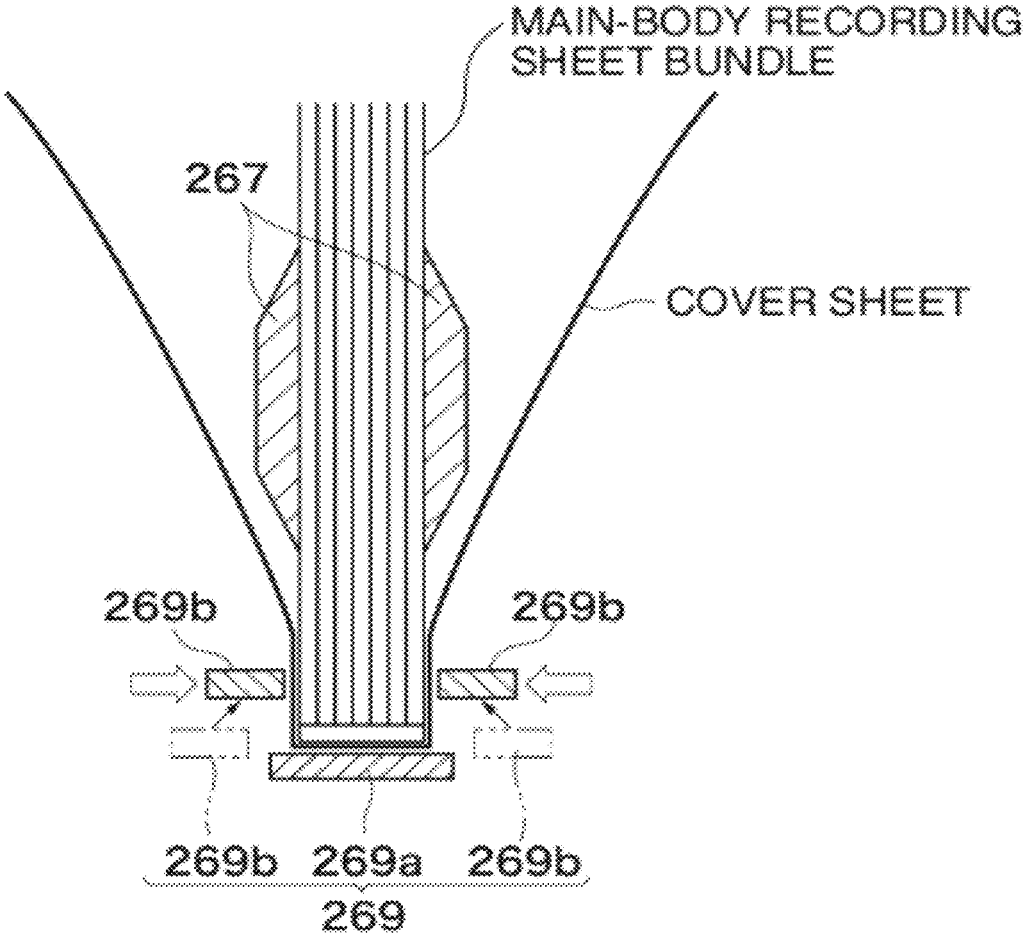
FIG. 4 is a diagram useful in explaining folding processing performed by a folding unit of the case binding machine.

After completion of the glue application, the CPU 301 causes the glue applying section 309 to stick the main-body recording sheet bundle having glue applied thereto to the central part of the cover sheet. At this time, the glue container 268 is in a state retracted from a glue-applying position, so that the main-body recording sheet bundle gripped by the gripper 267 is lowered to be stuck onto the cover sheet waiting between the cover sheet paths 264 and 265. By lowering the main-body recording sheet bundle, the cover sheet and the main-body recording sheet bundle are brought into abutment with the abutment member 269*a* of the folding unit 269 as shown in FIG. 4.

Thereafter, the CPU 301 causes the abutment member 269*a* of the folding unit 269 to be lowered, whereby the glue-applied main-body recording sheet bundle is lowered. In accordance with this lowering operation, the CPU 301 causes the pair of pressure members 269*b* of the folding unit 269 to be moved in directions indicated by respective arrows in FIG. 4 to thereby press the cover sheet and the main-body recording sheet bundle from the opposite sides. Thus, the glue-applied surface of the main-body recording sheet bundle is pressed, and the cover sheet is folded. The glue is still hot at this time point. Therefore, the CPU 301 causes a fan to operate in the glue cooling section 310 according to the glue temperature and the thickness of the main-body recording sheet bundle, whereby the glue applied to the main-body recording sheet bundle is cooled.

After the glue is cooled, the CPU 301 causes the cutting section 311 to perform cutting processing such that the recording sheet bundle bound into a book has a predetermined finish size. More specifically, after the folding unit 269 is retracted, the bundle conveying section 307 is controlled to drive a bundle conveying roller 270 to thereby move the recording sheet bundle to the trim gripper 271. The CPU 301 causes the cutting section 311 to move the recording sheet bundle while gripping the same from the opposite sides by the trim gripper 271, and then rotate the recording sheet bundle through 90 degrees.

Thereafter, the CPU 301 causes the recording sheet bundle gripped by the trim gripper 271 to be moved to a cutting position of the cutter 272, and then causes the cutter 272 to move in a direction indicated by an arrow B in FIG. 1 (i.e. leftward as viewed in FIG. 1), to thereby cut off a first side of the recording sheet bundle. At this time, the CPU 301 causes the chip collector section 313 to hold the chip receiver box 273 on standby immediately below the recording sheet bundle to collect chips cut off from the recording sheet bundle.

After causing the cutter 272 to cut the first side of the recording sheet bundle and then retract, the CPU 301 causes the trim gripper 271 to rotate the recording sheet bundle through 90 degrees and then moves the cutter 272 leftward again to cut a second side of the recording sheet bundle. After completion of the cutting of the second side of the recording sheet bundle, the CPU 301 causes the cutter 272 to retract again and causes the trim gripper 271 to rotate the recording sheet bundle through 90 degrees. Then, the CPU 301 causes the cutter 272 to cut a third side of the recording sheet bundle. Further, after completion of the cutting of the third side of the recording sheet bundle, the CPU 301 causes the cutter 272 to retract again and causes the trim gripper 271 to further rotate the recording sheet bundle through 90 degrees.

After completion of the cutting of the three sides of the recording sheet bundle, the CPU 301 causes the chip collector section 313 to move the chip receiver box 273 having collected cut-off chips therein in the direction indicated by the arrow C in FIG. 1 (i.e. rightward as viewed in FIG. 1) and open the chip receiver box bottom plate 274 in the direction indicated by the arrow D. This causes the cut-off chips collected in the chip receiver box 273 to be disposed of into the chip waste box 278.

The recording sheet bundle having undergone the bookbinding processing and the cutting processing as described above is discharged onto the book stacking tray 277 by the bundle stacking section 312. Since the recording sheet bundle has been rotated through 90 degrees by the trim gripper 271 four times, i.e. the recording sheet bundle has performed one rotation, the glue-applied surface of the recording sheet bundle faces downward. Immediately before starting the operation for discharging the recording sheet bundle subjected to the bookbinding processing, a book discharge stabilizing plate 276 has been lowered to a position retracted downward from a recording sheet bundle stacking surface of the book stacking tray 277.

The CPU 301 causes the stopper 279 of the book stacking tray 277 to be moved rightward, as viewed in FIG. 1, and after causing the recording sheet bundle having the three sides thereof cut off to be dropped onto the stacking plate 275, causes the stacking plate 275 to be erected vertically. In accordance with this motion of the stacking plate 275, the recording sheet bundle is erected on the book stacking tray 277 between the stopper 279 and the stacking plate 275. Thereafter, the CPU 301 causes the book discharge stabilizing plate 276 to be moved upward, whereby the recording sheet bundle is sandwiched between the stopper 279 and the book discharge stabilizing plate 276. Then, the CPU 301 causes both the stopper 279 and the book discharge stabilizing plate 276 to be moved leftward as viewed in FIG. 1, thereby completing the discharge of the recording sheet bundle onto the book stacking tray 277.

It should be noted that the case binding machine 260 has an inserter 261 attached thereto such that insert sheets (intermediate sheets and a cover sheet) can be inserted into the intermediate sheet path 263 and the cover sheet paths 264 and 265 via an inserter path 262. The use of the inserter 261 in a job involving bookbinding processing makes it possible to insert a recording sheet already having an image formed thereon or a special sheet difficult to convey in the digital copying machine 100 into a main-body recording sheet bundle conveyed from the digital copying machine 100.

Next, the arrangement of the finisher 290 will be described with reference to FIG. 1.

Recording sheets discharged one by one from the digital copying machine 100 are conveyed into the finisher 290 via the cover sheet paths 264 and 265 of the case binding machine 260, and are stacked and aligned on a processing tray 294. In the finisher 290, when discharge of the recording sheets as part of a print job is completed, post processing, such as stapling, is performed on the recording sheet bundle according to the settings of the print job configured in advance via the operating section 104, and then the recording sheet bundle is discharged onto a discharge tray 292 or 293.

Each of the discharge trays 292 and 293 is driven by a motor, not shown, for upward or downward motion. Before the start of conveyance of recording sheets, one of the discharge trays 292 and 293 is shifted to a position corresponding to that of the processing tray 294. Each time a recording sheet is stacked on the discharge tray during image forming operation, the discharge-tray is lowered such that the height of the top surface of recording sheets stacked on the discharge tray coincides with the position of the processing tray 294.

On an inserter 291 are stacked sheets to be inserted into a recording sheet bundle discharged onto the processing tray 294. A Z-folding device 295 folds a recording sheet to be discharged, into a Z shape. A saddle-stitching device 296 performs bookbinding by stapling the central part of a recording sheet bundle and folding the recording sheet bundle in half at the stapled central part. The recording sheet bundle subjected to the bookbinding by the saddle-stitching device 296 is discharged onto a discharge tray 297.

Next, processing for storing processing statuses during case binding performed on recording sheets discharged from the digital copying machine 100 by the case binding machine 260 of the above-configured digital copying system according to the present embodiment will be described with reference to FIGS. 5 to 9.

As described hereinabove, the RAM 303 of the case binding machine 260 stores a status data indicative of the current operational status (progress) of each of stacking processing, glue application processing, cutting processing, bundle stacking processing, and chip conveying processing. The operational statuses are the stacking processing status 500, the glue application processing status 600, the cutting processing status 700, the bundle stacking processing status 800, and the chip conveying processing status 900. Each of the status data of the respective operational statuses (500, 600, 700, 800, and 900) is updated in accordance with the progress of bookbinding processing. It should be noted that the RAM 303 is backed up by a battery, not shown, to store the status data of the processing statuses even after the power of the case binding machine is turned off. In short, the RAM 303 functions as a storage unit for storing operational statuses of the bookbinding apparatus according to the present invention.

Figure 5:
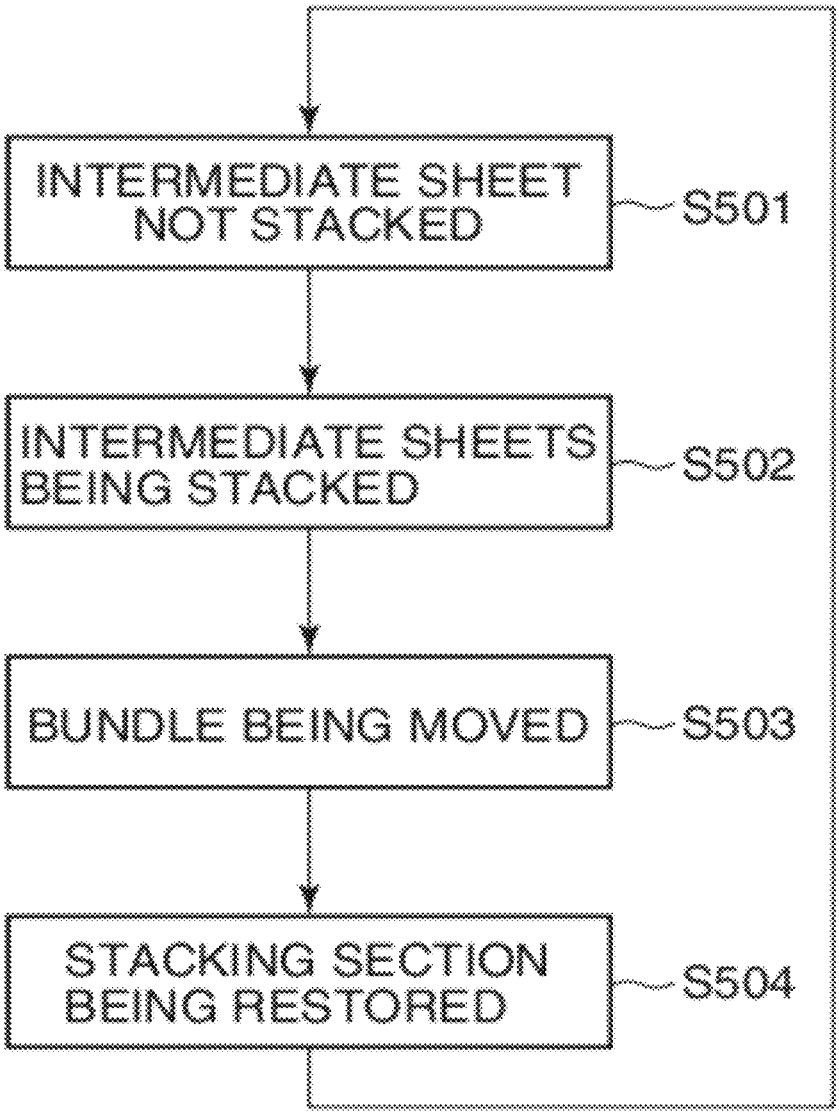
FIG. 5 is a diagram showing changes in a value indicative of a stacking processing status stored in a RAM.

FIG. 5 is a diagram showing changes in the status data indicative of the stacking processing status 500 stored in the RAM 303.

Referring to FIG. 5, the status (indicated by an associated predetermined value) is initially set to "not stacked" indicating that no recording sheets are stacked on the intermediate sheet stacking tray 266 (step S501). When the stacking of intermediate sheets (main-body recording sheets) on the intermediate sheet stacking tray 266 is started by the intermediate sheet-stacking section 305, the status changes to "intermediate sheets being stacked" indicating that intermediate sheets are being stacked (step S502). Further, when the stacking of intermediate sheets on the intermediate sheet stacking tray 266 is completed, the status changes to "bundle being moved" indicating that the movement of the gripper 267 is started and the preparation of a cover sheet is started by the cover sheet conveying section 306 (step S503). When the movement of the gripper 267 is completed, the status changes to "stacking section being restored" indicating that the intermediate sheet stacking tray 266 is preparing to receive next intermediate sheets (step S504). When the preparation is completed, the status returns to the step 501.

Figure 6:
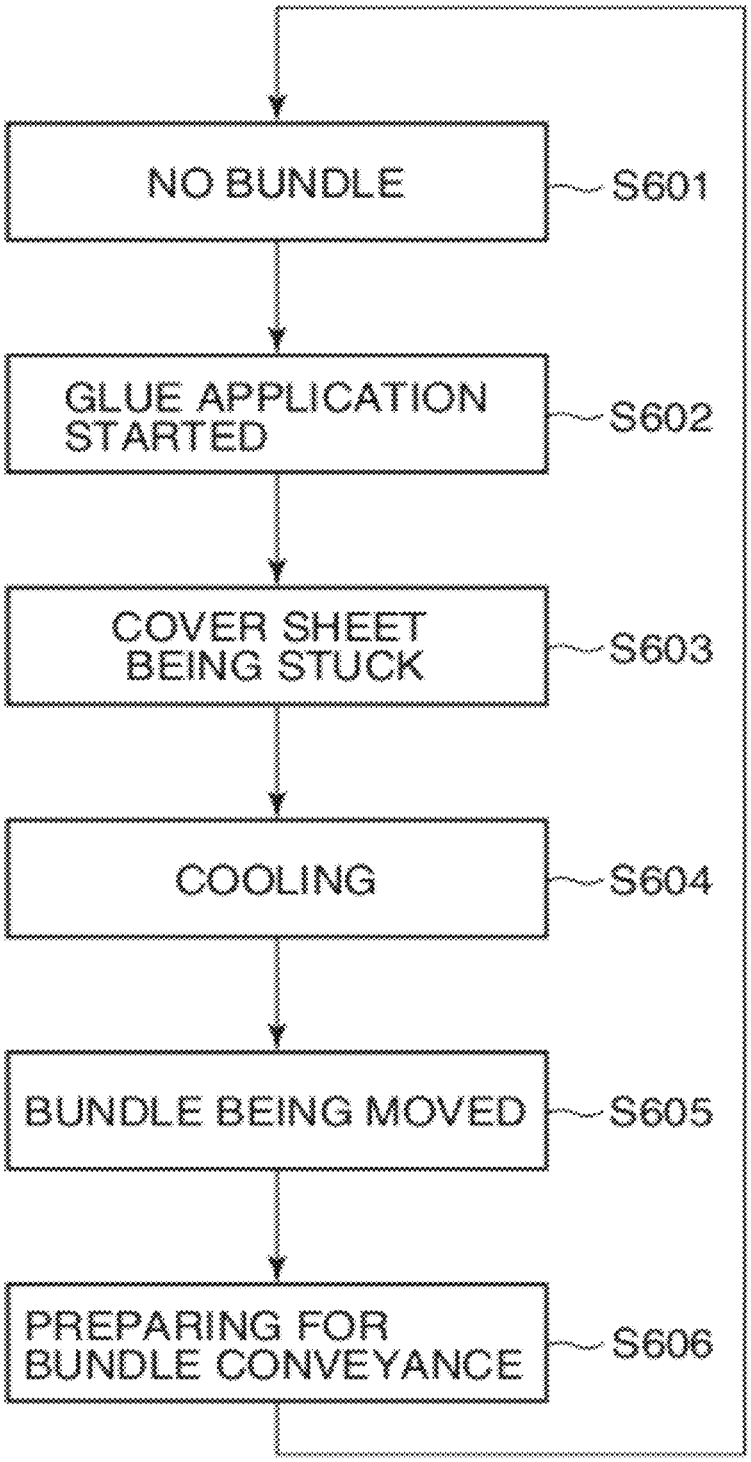
FIG. 6 is a diagram showing changes in a value indicative of a glue application processing status stored in the RAM.

FIG. 6 is a diagram showing changes in the status data indicative of the glue application processing status 600 stored in the RAM 303.

As shown in FIG. 6, the status is initially set to "no bundle" indicating that the gripper 267 currently does not grip a main-body recording sheet bundle to which glue is to be applied (step S601). When a main-body recording sheet bundle gripped by the gripper 267 after having been stacked on the intermediate sheet stacking tray 266 in the stacking processing and a cover sheet are prepared, the status changes to "glue application started" (step S602). When the application of glue to the main-body recording sheet bundle is completed by the glue applying section 309, the status changes to "cover being stuck" indicating that processing for causing the main-body recording sheet bundle and the cover sheet to be stuck to each other by lowering the gripper 267, and folding the cover by the folding unit 269 is being executed (step S603).

When the folding of the cover sheet stuck to the main-body recording sheet bundle is completed, the status changes to "cooling" indicating that the glue cooling section 310 is cooling hot glue applied to the recording sheet bundle with the cover sheet, by operating the fan, not shown (step S604). When the cooling of the recording sheet bundle with the cover sheet is completed, the status changes to "bundle being moved" indicating that processing for further lowering the gripper 267 and passing the recording sheet bundle with the cover sheet to the bundle conveying roller 270 is being executed by the bundle conveying section 307 (step S605). Thereafter, when the gripper 267 is moved upward, the status changes to "preparing for bundle conveyance" indicative of a state preparing to receive a next main-body recording sheet bundle stacked on the intermediate sheet stacking tray 266 (step S606). When the upward movement of the gripper 267 is completed, the status returns to "no bundle" (step S601).

Figure 7:
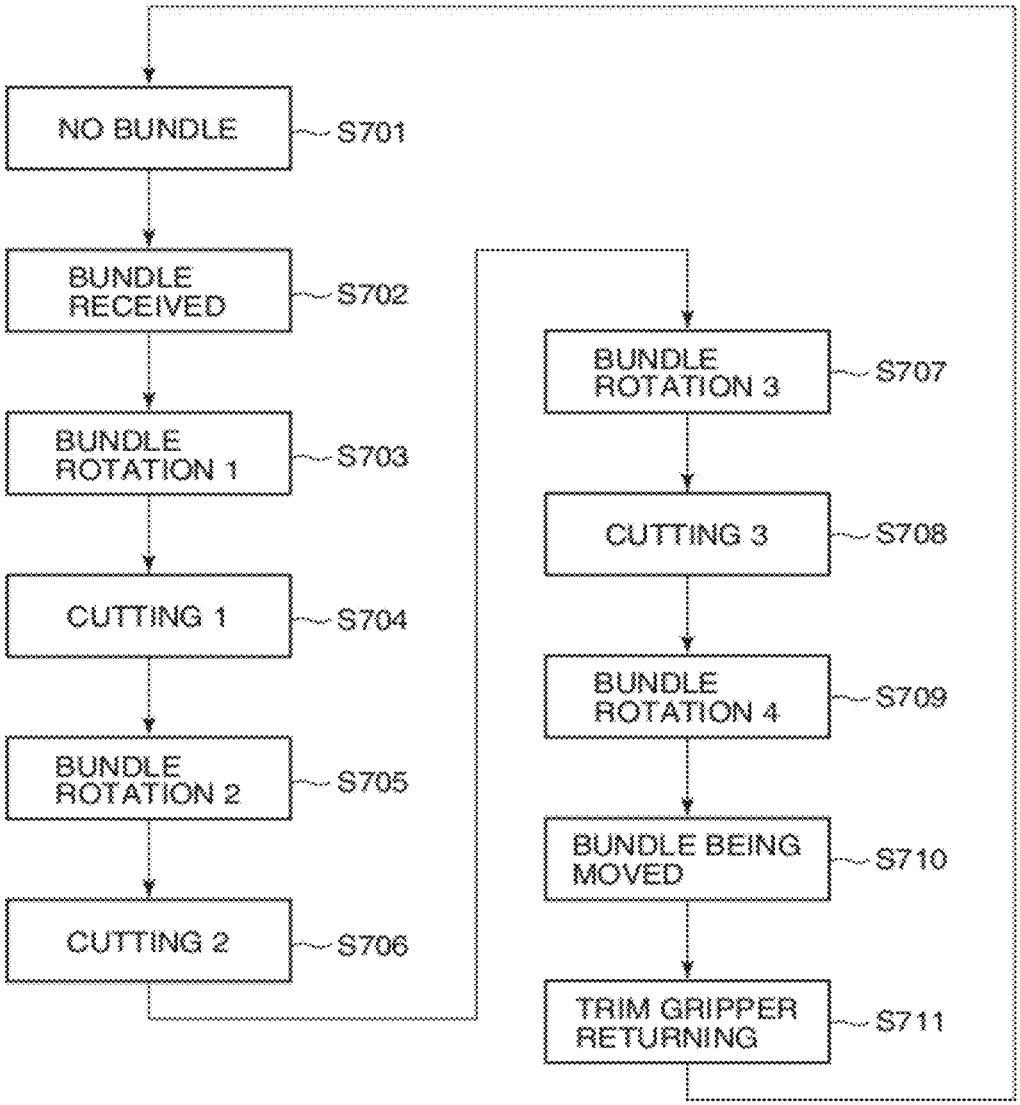
FIG. 7 is a diagram showing changes in a value indicative of a cutting processing status stored in the RAM.

FIG. 7 is a diagram showing changes in the status data indicative of the cutting processing status 700 stored in the RAM 303.

Referring to FIG. 7, the status is initially set to "no bundle" indicating that the gripper 267 currently does not grip a recording sheet bundle which is to be cut (step S701). When the glue-applied recording sheet bundle is passed from the gripper 267 to the trim gripper 271 via the bundle conveying roller 270, the status changes to "bundle received" (step S702). Thereafter, the cutting section 311 is controlled to alternately carry out the processing for rotating the recording sheet bundle by the trim gripper 271 and the processing for cutting a side (other than the glue-applied side) of the recording sheet bundle by the cutter 272.

More specifically, the status sequentially changes to "bundle rotation 1" (step S703), "cutting 1" (step S704), "bundle rotation 2" (step S705), "cutting 2" (step S706), "bundle rotation 3" (step S707), "cutting 3" (step S708), and "bundle rotation 4" (step S709) in the mentioned order. When the cutting of the three sides of the recording sheet bundle by the cutter 272 is completed, the status changes to "bundle being moved" indicating that processing for lowering the recording sheet bundle gripped by the trim gripper 271 to pass the same to the bundle stacking section 312 is being executed (step S710). When the delivery of the recording sheet bundle is completed, the status changes to "trim gripper returning" indicating that processing for moving the trim gripper 271 upward so as to become prepared for receiving a next recording sheet bundle from the glue applying section 309 is being executed (step S711).

Figure 8:
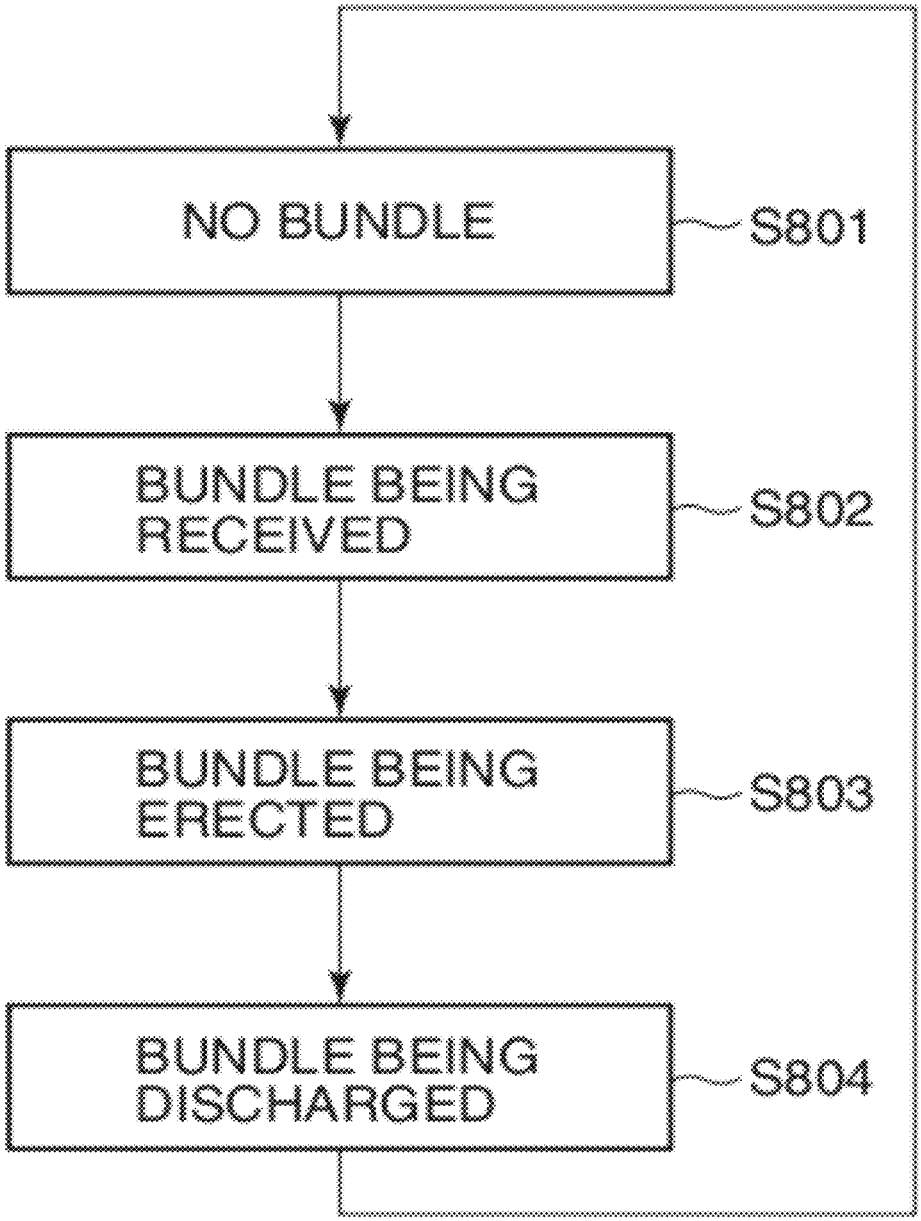
FIG. 8 is a diagram showing changes in a value indicative of a bundle stacking processing status stored in the RAM.

FIG. 8 is a diagram showing changes in the status data indicative of the bundle stacking processing status 800 stored in the RAM 303.

As shown in FIG. 8, the status is initially set to "no bundle" indicating that there is no recording sheet bundle in the bundle stacking section 312 before passing of a recording sheet bundle having undergone the cutting processing from the cutting section 311 to the bundle stacking section 312 (step S801). Thereafter, the status changes to "bundle being received" indicating that processing for tilting the stacking plate 275 to receive the recording sheet bundle is being executed (step S802). Then, when the passing of the recording sheet bundle from the trim gripper 271 is completed, the status changes to "bundle being erected" indicating that processing for erecting the stacking plate 275 to erect the recording sheet bundle on the book stacking tray 277 is being executed (step S803).

After the recording sheet bundle is erected, the status changes to "bundle being discharged" indicating that processing for discharging the recording sheet bundle from the book stacking tray 277 is being executed (step S804). More specifically, the recording sheet bundle is sandwiched between the stopper 279 of the book stacking tray 277 and the book discharge stabilizing plate 276 moved upward from the lower surface of the book stacking tray 277, and then the stopper 279 and the book discharge stabilizing plate 276 are shifted leftward, as viewed in FIG. 1, to thereby discharge the recording sheet bundle. When the discharge of the recording sheet bundle is completed, the status returns to "no bundle" (step S801).

Figure 9:
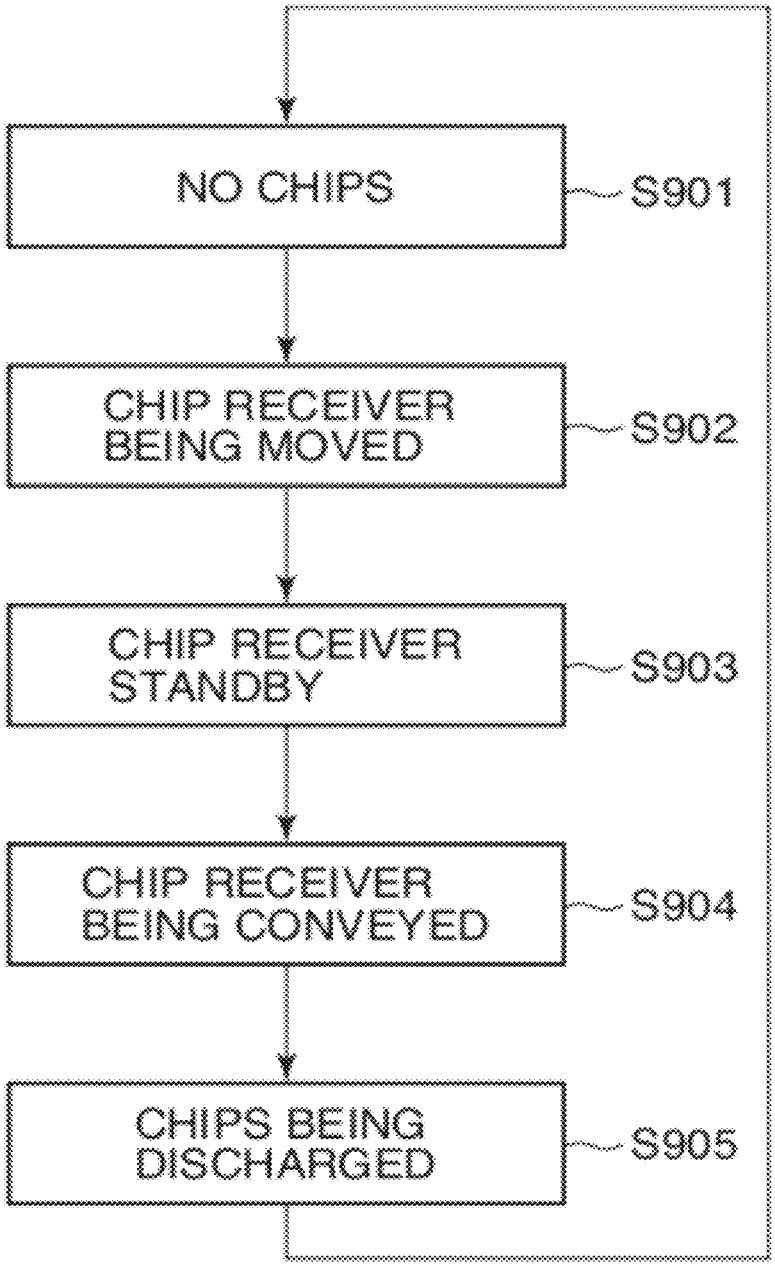
FIG. 9 is a diagram showing changes in a value indicative of a chip conveying processing status stored in the RAM.

FIG. 9 is a diagram showing changes in the status data indicative of the chip conveying processing status 900 stored in the RAM 303.

Referring to FIG. 9, when the cutting processing is not being executed, no cut-off chips are produced, and hence the status is "no chips" indicating that the chip receiver box 273 is on standby above the chip waste box 278 (step S901). When the bundle stacking processing status changes to "bundle being received" (step S802 in FIG. 8), the chip conveying processing status changes to "chip receiver being moved" indicating that processing for moving the chip receiver box 273 to the cutting position so as to receive cut-off chips is being executed (step S902).

When the chip receiver box 273 is moved to the cutting position, the status changes to "chips being awaited" indicating that the chip receiver box 273 is on standby at the cutting position, for collecting cut-off chips falling from the recording sheet bundle when the recording sheet bundle is cut, until the cutting of the three sides of the recording sheet bundle is completed in the cutting processing (step S903). Then, when the cutting processing status changes to "bundle rotation 4" (step S709), no cut-off chips will fall from then on, and therefore the status changes to "chips being conveyed" (step S904). In this status "chips being conveyed", the chip collector section 313 moves the chip receiver box 273 to a position above the chip waste box 278. When the movement of the chip receiver box 273 is completed, the status changes to "chips being discharged" (step S905). In this status "chips being discharged", the chip receiver box bottom plate 274 is opened, whereby cut-off chips in the chip receiver box 273 are discharged into the chip waste box 278.

The status data indicative of the respective operational statuses of the stacking processing, the glue application processing, the cutting processing, the bundle stacking processing, and the chip conveying processing, which are stored in the RAM 303, are sequentially updated by the CPU 301 in accordance with the progress of the sequence of operations for the bookbinding processing. This makes it possible to execute the bookbinding processing on a plurality of recording sheet bundles in succession.

Next, a method of preparing glue for use in the bookbinding processing executed by the case binding machine will be described with reference to FIGS. 10A and 10B.

Figure 10A:
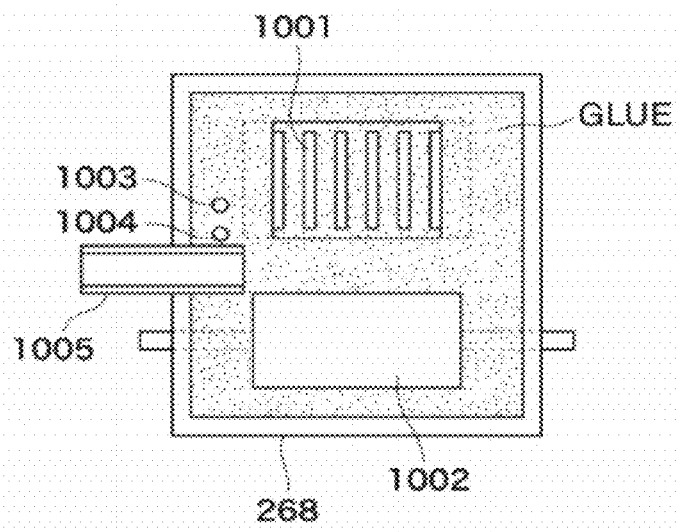
FIG. 10A is a top view of a glue container of the case binding machine.
Figure 10B:
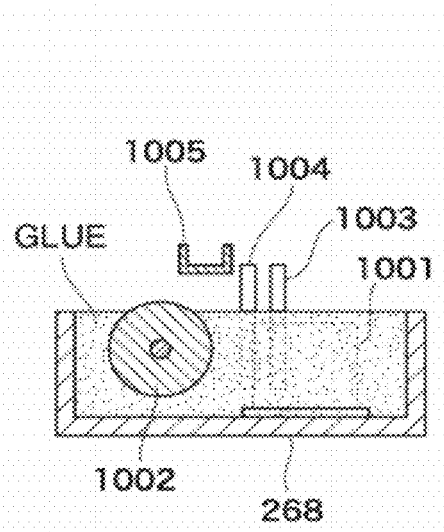
FIG. 10B is a side cross-sectional view of the glue container of the case binding machine.

FIGS. 10A and 10B are views of the glue container 268 of the case binding machine. FIG. 10A is a top view, and FIG. 10B a side cross-sectional view.

As shown in FIGS. 10A and 10B, the glue container 268 contains glue to be heated by the glue preparation section 308 and be applied by the glue applying section 309. The glue container 268 is equipped with the heater 1001, the stirring roller 1002, a temperature sensor 1003, and a liquid level sensor 1004. The heater 1001 heats the glue within the glue container 268. The stirring roller 1002 stirs the glue within the glue container 268. The temperature sensor 1003 measures the temperature of the glue within the glue container 268. The liquid level sensor 1004 detects the liquid level of the glue within a gutter 1005. The gutter 1005 is disposed above the glue container 268, and is used to supply the glue container 268 with spherical solid glues.

Immediately after the power-on of the case binding machine, the glue within the glue container 268 is cold and solid, and hence, in this state, it cannot be used to stick a cover sheet and a main-body recording sheet bundle to each other. For this reason, the glue within the glue container 268 is heated and melted by the heater 1001 before glue application. The CPU 301 causes the glue preparation section 308 to heat and melt the glue while performing ON/OFF control of the heater 1001 such that the glue temperature measured by the temperature sensor 1003 is maintained at a target temperature suited to the glue application processing.

In the present embodiment, the first preparation operation and the second preparation operation are selectively performed. The first target temperature as a target glue temperature for heating and melting processing in the first preparation operation is set to be higher than the second target temperature as a target glue temperature in the second preparation operation. The first preparation operation is selected when there is no recording sheet bundle to which glue is to be applied at the power-on of the case binding machine, while the second preparation operation is selected when there is a recording sheet bundle to which glue is to be applied at the power-on of the case binding machine.

It should be noted that a bookbinding process executed when there is no recording sheet bundle to which glue is to be applied at the power-on of the case binding machine will be referred to as the normal bookbinding process, and a bookbinding process executed when there is a recording sheet bundle to which glue is to be applied at the power-on of the case binding machine will be referred to as the abnormal bookbinding process.

However, when only glue around the temperature sensor 1003 inserted in the glue container 268 is warm, glue application is impossible. In other words, glue is sufficiently molten only in the vicinity of the temperature sensor 1003 in the glue container 268, and hence it is required to conduct heat to the whole glue in the glue container 268. To this end, when the glue temperature measured by the temperature sensor 1003 reaches the target temperature, stirring processing for stirring the glue in the glue container 268 by the stirring roller 102 is carried out for e.g. 30 seconds to make the glue temperature uniform in the glue container 268. When this stirring processing is completed, the glue preparation is completed. A time period required for stirring glue in the stirring processing in the second preparation operation is set to be shorter than a time period required for stirring glue in the stirring processing in the first preparation operation.

Figure 11:
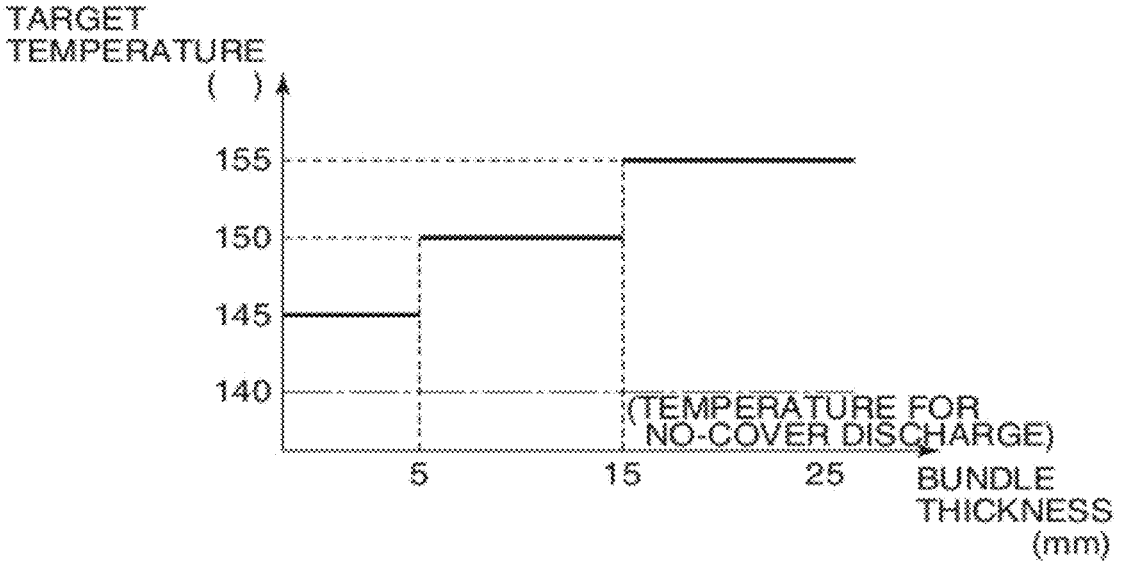
FIG. 11 is a diagram useful in explaining the relationship between the thickness of a recording sheet bundle to be bound into a book by the case binding machine and a target glue temperature.

As shown in FIG. 11, the target glue temperature is set to be higher as the thickness of a cover sheet-glued recording sheet bundle to be subjected to bookbinding is larger. In FIG. 11, when a recording sheet bundle has a thickness of e.g. 10 mm, the target glue temperature is set to 150° C. The gripper 267 (see FIG. 1) for use in the glue application processing has a measurement section (not shown) for measuring the thickness of a recording sheet bundle, based on a distance between a pair of gripping members, while gripping the recording sheet bundle. The CPU 301 uses this measurement section to perform control for switching the target glue temperature based on the measured thickness of the recording sheet bundle gripped by the gripper 267.

As the thickness of a recording sheet bundle is larger, a larger amount of heat in the glue container 268 is taken away by the recording sheet bundle. Further, an increase in the amount of glue to be applied to the recording sheet bundle causes an increase in the amount of solid glue to be supplied from the gutter 1005 for replenishment of the glue container 268. For this reason, it is required to melt the supplied solid glue in a very short time. Therefore, as the thickness of a recording sheet bundle is larger, the target glue temperature is set to be higher. In FIG. 11, the target glue temperature is set to 150° C. in the normal bookbinding mode. Further, in the case of discharging a recording sheet bundle without a cover sheet onto the book stacking tray 277, the target glue temperature is set to 140° C. irrespective of the thickness of the recording sheet bundle.

Next, processes which characterize the present embodiment and are executed when the power of the case binding machine is turned off during a bookbinding operation and when the power of the case binding machine is turned on will be described with reference to FIGS. 12, 13A, and 13B.

Figure 12:
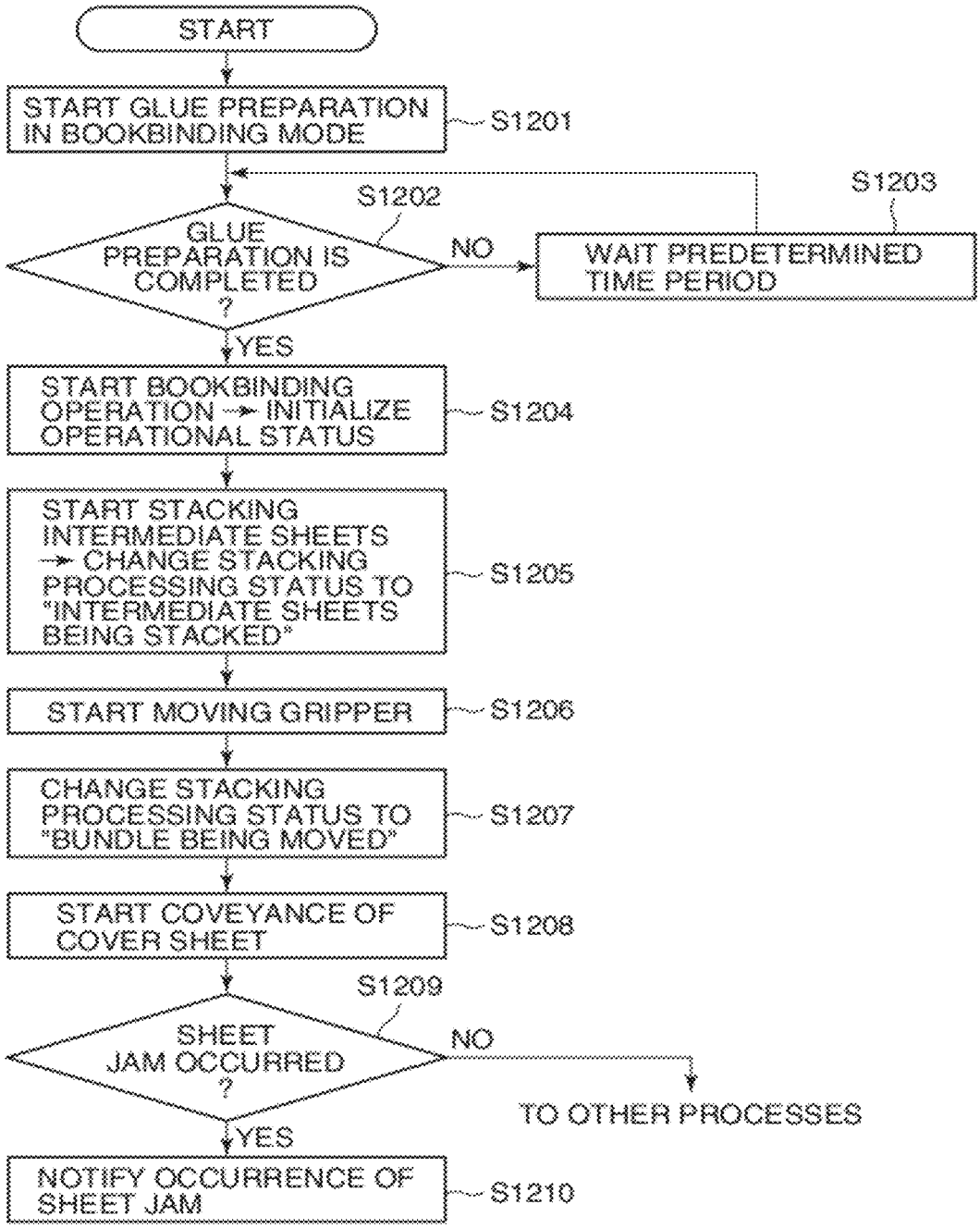
FIG. 12 is a flowchart of a process executed before the power of the case binding machine is turned off after occurrence of a sheet jam during bookbinding operation, with a recording sheet bundle remaining in the case binding machine.

FIG. 12 is a flowchart of a process executed before the power of the case binding machine is turned off after occurrence of a sheet jam during bookbinding operation, with a recording sheet bundle remaining in the case binding machine.

As shown in FIG. 12, when executing the normal bookbinding process, the CPU 301 causes the glue preparation section 308 to start preparing glue required for bookbinding, before starting a bookbinding operation (step S1201). The target glue temperature is set to 150° C. in the normal bookbinding mode (see FIG. 11), and therefore, when the glue temperature reaches 150° C., the CPU 301 causes the stirring roller 1002 to start stirring the glue in the glue container 268 and continues this stirring operation for 30 seconds. Then, the CPU 301 determines whether or not the glue preparation has been completed (step S1202). If the glue preparation has not been completed (NO to the step S1202), the CPU 301 awaits completion of the glue preparation over a predetermined time period (step S1203).

When the stirring operation is completed, the glue preparation is completed (YES to the step S1202). Then, the CPU 30 causes the bookbinding operation to be started by initializing the status of each of the stacking processing, the glue application processing, the cutting processing, the bundle stacking processing, and the chip conveying processing as follows (step S1204). More specifically, the CPU 301 initializes the status of the stacking processing to S501 "not stacked", that of the glue application processing to "no bundle", that of the cutting processing to "no bundle", that of the bundle stacking processing to "no bundle", and that of the chip conveying processing to "no chips".

Thereafter, the stacking of intermediate sheets (main-body recording sheets) on the intermediate sheet stacking tray 266 is started by the intermediate sheet-stacking section 305, and hence the CPU 301 changes the status of the stacking processing to "intermediate sheets being stacked" (step S1205). When the stacking of recording sheets on the intermediate sheet stacking tray 266 is completed, the recording sheet bundle is passed to the gripper 267 from the intermediate sheet stacking tray 266, and the CPU 301 measures the thickness of the recording sheet bundle by the measurement section of the gripper 267.

Thereafter, the CPU 301 causes the bundle conveying section 307 to start moving the gripper 267 (step S1206). At the same time, the CPU 301 changes the status of the stacking processing to "bundle being moved" (step S1207) and causes the cover sheet conveying section 306 to start conveyance of a cover sheet (step S1208).

Then, the CPU 301 determines whether or not a sheet jam has occurred in the case binding machine (step S1209). It should be noted that a sheet jam occurs e.g. due to failure in conveyance of a cover sheet. If no sheet jam has occurred, the process proceeds to another process. If a sheet jam has occurred in the case binding machine, the CPU 301 notifies the digital copying machine 100 of the fact (step S1210). Upon reception of this notification, the digital copying machine 100 displays a message indicative of the occurrence of the sheet jam on the operating section 104. In response to this message, the operator may turn off the power of the case binding machine so as to remove a jammed sheet. In this case, of the stacking processing status 500, the glue application processing status 600, the cutting processing status 700, the bundle stacking processing status 800, and the chip conveying processing status 900 stored in the RAM 303, only the value of the stacking processing status 500 has been changed to "bundle being moved", and the values of the other processing statuses all remain initialized.

Figure 13A:
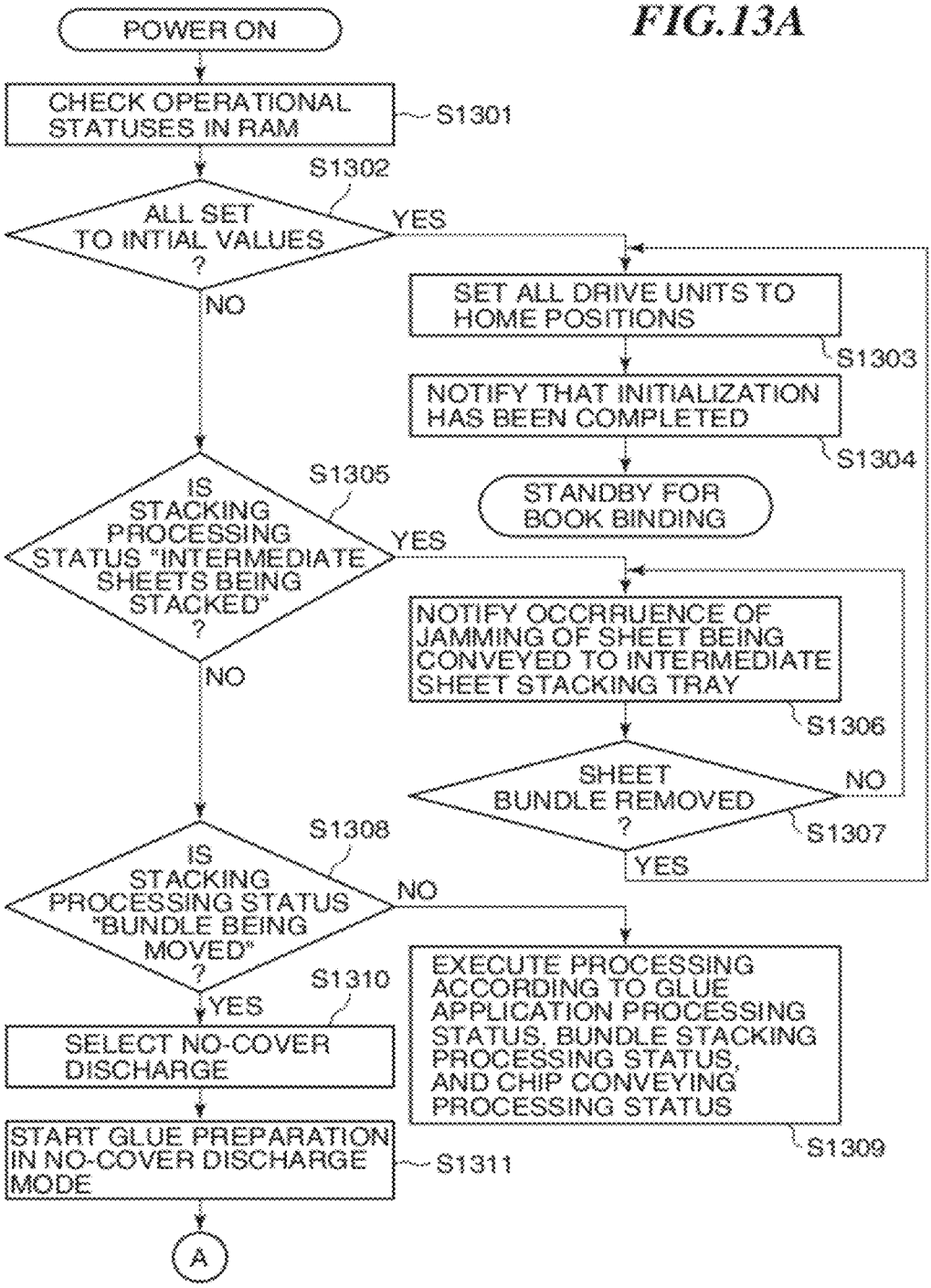
FIG. 13A is a flowchart of a process executed when the power of the case binding machine is turned on again after the power having been turned off with a recording sheet bundle, which is to be glued, remaining in the case binding machine.
Figure 13B:
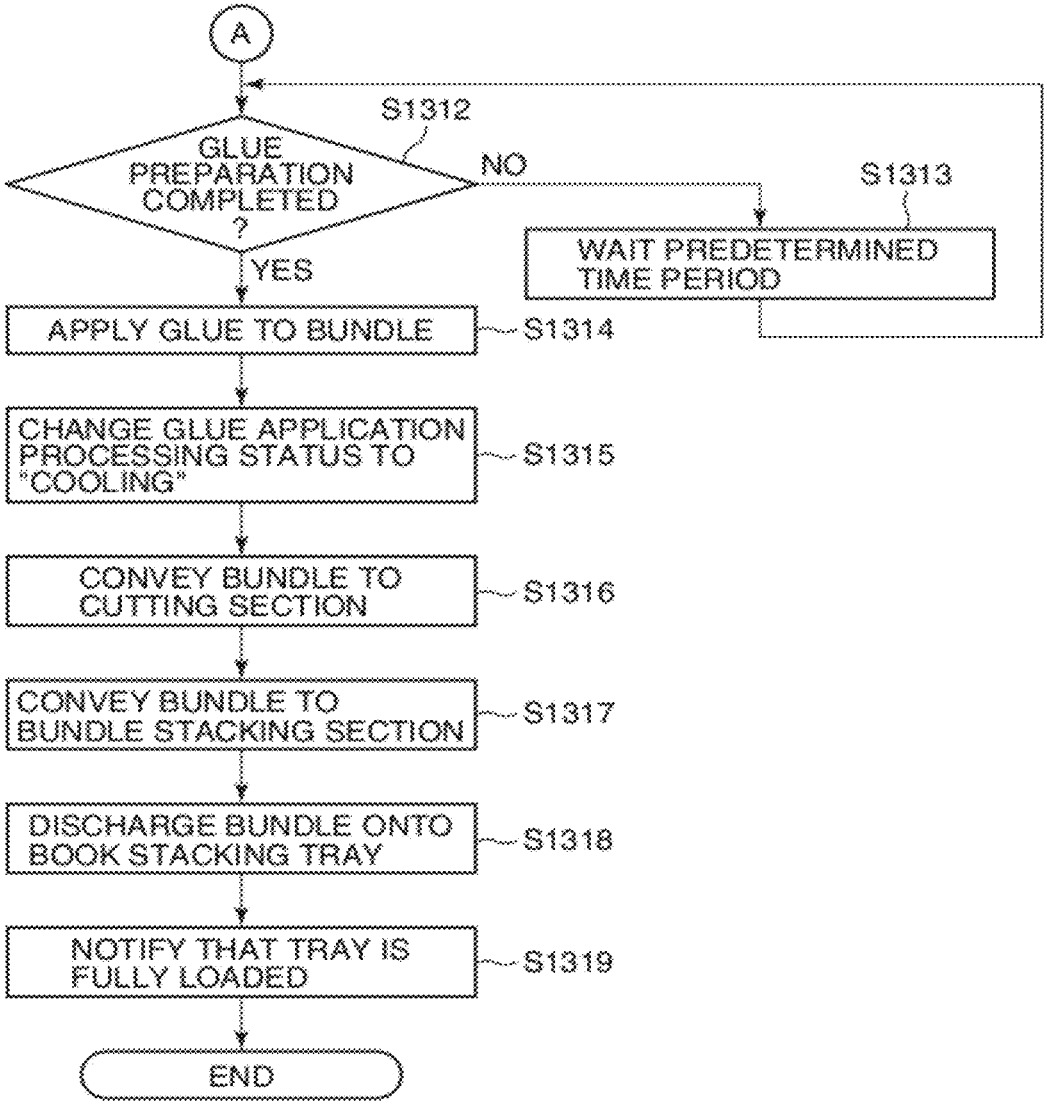
FIG. 13B is a continuation of FIG. 13A.

FIGS. 13A and 13B are a flowchart of a process executed when the power of the case binding machine is turned on again after the power is turned off with a recording sheet bundle to which glue is to be applied remaining in the case binding machine.

Referring to FIG. 13A, when the power of the case binding machine is turned on by the operator, the CPU 301 of the case binding machine checks the operational statuses of the stacking processing, the glue application processing, the cutting processing, the bundle stacking processing, and the chip conveying processing stored in the RAM 303 (step S1301). When the values of the respective operational statuses all remain initialized (YES to S1302), the CPU 301 perform normal starting processing, i.e. home position setting processing for setting each of the various drive units within the case binding machine to an associated initial position (step S1303). When the home position setting processing is completed, the CPU 301 notifies the digital copying machine 100 of the completion of the initialization, via the communication section 304 (step S1304).

In the digital copying machine 100, at a time point when initialization in the same is completed and initialization completion notifications are received from both the finisher and the case binding machine, the operator is permitted to configure settings for execution of a copying operation via the operating section 104.

If it is determined in the step S1302 that some processing status assumes a value other than its initial value, the CPU 301 determines whether or not the value of the stacking processing status 500 is indicative of "intermediate sheets being stacked" (step S1305). If the value of the stacking processing status 500 is indicative of "intermediate sheets being stacked", the CPU 301 notifies the digital copying machine 100, via the communication section 304, that a sheet being conveyed to the intermediate sheet stacking tray 266 has caused a sheet jam (step S1306).

The notification of the sheet jam is displayed on the operating section 104 of the digital copying machine 100. In response to the notification, the operator removes the jammed sheet and opens a top cover, not shown, of the case binding machine to manually remove recording sheets stacked on the intermediate sheet stacking tray 266. When it is determined that the recording sheets have been removed (YES to a step S1307), the CPU 301 performs the home position setting processing for each of the drive units so as to return to the normal starting processing (step S1303). Then, the CPU 301 notifies the digital copying machine 100 of the completion of the initialization, via the communication section 304 (step S1304).

If it is determined in the step S1305 that the value of the stacking processing status 500 is not indicative of "intermediate sheets being stacked", the CPU 301 determines whether or not the value of the stacking processing status 500 is indicative of "bundle being moved" (step S1308). If the value of the stacking processing status 500 is indicative of "bundle being moved", the CPU 301 determines that a recording sheet bundle to which glue is to be applied remains in the case binding machine. As a consequence, the CPU 301 selects a method (no-cover discharge) in which glue is applied to the end of the recording sheet bundle and the recording sheet bundle is discharged without having a cover sheet stuck thereto, as a method of recovering the case binding machine (step S1310).

It should be noted that when the value of the stacking processing status 500 is indicative of "not stacked" or "stacking section being restored" (NO to the step S1308), it is impossible to determine a state of recording sheets remaining on the intermediate sheet stacking tray 266. For this reason, the CPU 301 performs processing according to the value of each of the glue application processing status 600, the cutting processing status 700, the bundle stacking processing status 800, and the chip conveying processing status 900 (step S1309).

More specifically, when the value of the glue application processing status 600 is indicative of "glue application started", the recording sheet bundle has glue applied thereto though not stuck to a cover sheet, and hence the CPU 301 executes no-cover discharge for discharging the uncovered recording sheet bundle. In this case, since the recording sheet bundle already has glue applied thereto, the recording sheet bundle is immediately discharged onto the book stacking tray 277 without being subjected to cutting processing. If there is a cover sheet for bookbinding in the case binding machine at this time, the CPU 301 prompts the operator to remove the cover sheet, and then executes no-cover discharge.

When the value of the glue application processing status 600 is indicative of "cover being stuck" or "cooling", the CPU 301 waits until the glue applied to the recording sheet bundle is dried, and then moves the recording sheet bundle so as to proceed to the cutting processing.

When the value of the glue application processing status 600 is indicative of "bundle being moved", the CPU 301 immediately restarts the movement of the recording sheet bundle so as to proceed to the cutting processing.

When the value of the glue application processing status 600 is indicative of "no bundle" or "bundle conveyance restarting", no recording sheet bundle is being processed, and hence the home position setting processing is performed for the drive unit associated with the glue application processing.

When the cutting processing status 700 assumes a value other than the value indicative of "no bundle" or "trim gripper returning", the CPU 301 causes the cutting section 311 to resume cutting of the recording sheet bundle.

When the value of the cutting processing status 700 is indicative of "no bundle" or "trim gripper returning", no recording sheet bundle is being processed in the case binding machine, and hence the home position setting processing is performed for the drive unit associated with the cutting processing.

When the bundle stacking processing status 800 assumes a value other than the value indicative of "no bundle", there is a recording sheet bundle which is being processed, and hence the CPU 301 immediately causes the bundle stacking section 312 to resume stacking of the recording sheet bundle on the book stacking tray 277.

When the value of the bundle stacking processing status 800 is indicative of "no bundle", the home position setting processing is performed for the drive unit associated with the bundle stacking processing.

The value of the chip conveying processing status 900 changes according to the value of the cutting processing status 700. More specifically, to perform cutting processing on a recording sheet bundle, it is required that the value of the chip conveying processing status 900 is changed to "chips being awaited" S903 indicating that the chip receiver box 273 is ready to receive cut-off chips produced during the cutting of the recording sheet bundle. In the other cases, as in the normal starting processing, the home position setting processing for returning the chip receiver box 273 to its initial position is executed.

When no-cover discharge is selected in the step S1310, the CPU 301 causes the glue preparation section 308 to start glue preparation. In this case, the recording sheet bundle is not to be normally discharged (i.e. is to be discharged without a cover). Therefore, the CPU 301 sets the target glue temperature in the glue container 268 and the glue stirring time period to a target glue temperature and a glue stirring time period in a no-cover discharge mode, respectively, and then starts glue preparation (step S1311). It should be noted that the target glue temperature and the glue stirring time period set in the no-cover discharge mode are stored in the RAM 303.

As shown in FIG. 11, the target glue temperature in the no-cover discharge mode (indicated by a one-dot-chain line) is set to 140° C., irrespective of the thickness of a recording sheet bundle, which is lower than the target glue temperature determined according to the thickness of a recording sheet bundle to be employed in the normal bookbinding process. In short, in the no-cover discharge mode, the second preparation operation is performed. This makes shorter a time period required to heat the glue in the glue container 268 to the target glue temperature in the no-cover discharge mode than in the normal mode.

Further, the glue stirring time period in the no-cover discharge mode is set to 15 seconds, which is half the normal glue stirring time period of 30 seconds. In short, the second preparation operation is performed. This is because in the no-cover discharge mode, the number of uncovered recording sheet bundles to be subjected to glue application is limited to one copy, and in the glue application as well, it is more important to shorten a time period taken to discharge the uncovered recording sheet bundle than to achieve a high-quality finish by sufficiently melting and stirring glue.

Specifically, since sufficient glue stirring is not performed in the no-cover discharge mode, the glue-applied surface of an uncovered recording sheet bundle can fall short of smoothness of a level required by a product even though it has molten glue applied thereto. However, the recording sheet bundle is to be disposed of, and hence it need not have a high quality. What is important is to promptly discharge the recording sheet bundle to be disposed of, and to be prepared for bookbinding of a new recording sheet bundle.

When the glue is prepared in the no-cover discharge mode as described above (YES to a step S1312), the CPU 301 causes the glue applying section 309 to apply the glue to the uncovered recording sheet bundle (step S1314). After completion of application of the glue to the uncovered recording sheet bundle, the value of the glue application processing status 600 changes to "cooling" by skipping "cover being stuck" (step S1315). It should be noted that when the glue preparation is not completed (NO to the step S1312), the CPU 301 waits for a predetermined time period (step S1313).

In the cooling status, it takes longer to cool the glue than in the normal bookbinding operation because the recording sheet bundle has no cover stuck thereto, but since the glue temperature is lower than in the normal mode, it is possible to cool the glue by applying air to the same using the fan within the glue cooling section 310 over the same time period as in the normal bookbinding operation. Then, the CPU 301 causes the bundle conveying section 307 to convey the uncovered recording sheet bundle to the cutting section 311 (step S1316). In this case, since no-cover discharge is to be executed, the uncovered recording sheet is immediately conveyed to the bundle stacking section 312 without being subjected to cutting processing (step S1317), and is discharged onto the book stacking tray 277 (step S1318).

Finally, the CPU 301 notifies the digital copying machine 100, via the communication section 304, that the book stacking tray 277 is fully loaded (step S1319), so as to prompt the operator to take out the uncovered recording sheet bundle from the case binding machine. When notified by the case binding machine that the book stacking tray 277 is fully loaded, the digital copying machine 100 displays a message "The tray is fully loaded" on the operating section 104 so as to prompt the operator to take out the uncovered recording sheet. It should be noted that a message, such as "Remove the unfinished recording sheet bundle", may be displayed. In response to the message, the operator takes out the uncovered recording sheet bundle from the case binding machine, followed by terminating the present process.

As described above, according to the present embodiment, the normal bookbinding process is executed by causing the glue applying section 309 to perform a first glue application process on a recording sheet bundle using glue prepared by the glue preparation section 308 in a first glue preparation step. On the other hand, when it is determined at the power-on of the machine, based on the operational statuses stored in the RAM 303, that there is a recording sheet bundle to which glue is to be applied in the case binding machine, the glue applying section 309 performs a second glue application process on the recording sheet bundle using glue prepared in a second glue preparation step in which the glue can be made ready in a shorter time period than in the first glue preparation step.

This makes it possible to shorten a time period required for glue preparation when the power of the case binding machine is turned on again after the power-off of the case binding machine immediately before application of glue to a recording sheet bundle. As a consequence, when a recording sheet bundle to which glue is to be applied remains in the case binding machine at the power-on of the same, it is possible to discharge the recording sheet bundle in a reduced time.

Although in the above described embodiment, not only the case binding machine but also the finisher is connected as a post-processing apparatus to the digital copying machine 100, this is not limitative, but the kind of a post-processing apparatus other than the case binding machine and the number of post-processing apparatuses can be determined as desired. Further, the present invention is also applicable to a case where only the case binding machine is employed as a post-processing apparatus.

Furthermore, although in the above described embodiment, the image forming apparatus connected to the case binding machine is implemented by the digital copying machine, this is not limitative, but the present invention is also applicable to a case where a printer is connected to the case binding machine.

While the present invention has been described with reference to the exemplary embodiment, it is to be understood that the invention is not limited to the disclosed exemplary embodiment. The scope of the following claims is to be accorded the broadest interpretation so as to encompass all modifications, equivalent structures and functions.

This application claims priority from Japanese Patent Application No. 2008-156718 filed Jun. 16, 2008, which is hereby incorporated by reference herein in its entirety.

What is claimed is:

1. A bookbinding apparatus for performing a bookbinding processing by applying an adhesive to an end of a recording sheet bundle and sticking a cover sheet to the end of the recording sheet bundle, the bookbinding apparatus comprising:

a heating unit configured to heat the adhesive;

a temperature detecting unit configured to detect a temperature of the adhesive;

an adhesive applying unit configured to apply the adhesive heated by said heating unit to the end of the recording sheet bundle;

a determination unit configured to determine, at power-on of the bookbinding apparatus, whether or not any recording sheet bundle to which the adhesive has not been applied within the bookbinding apparatus exists; and a control unit configured to:

when said determination unit determines, at the power-on of the bookbinding apparatus, that no recording sheet bundle to which the adhesive has not been applied within the bookbinding apparatus exists, control said adhesive applying unit to apply the adhesive to a recording sheet bundle after said temperature detecting unit detects that the temperature of the adhesive has reached a first temperature; and when said determination unit determines, at the power-on of the bookbinding apparatus, that a recording sheet bundle to which the adhesive has not been applied within the bookbinding apparatus exists, control said adhesive applying unit to apply the adhesive to the recording sheet bundle after said temperature detecting unit detects that the temperature of the adhesive has reached a second temperature, which is lower than the first temperature.

2. The bookbinding apparatus according to claim 1, further comprising:

a stirring unit configured to stir the adhesive heated by said heating unit, wherein when said determination unit determines, at the power-on of the bookbinding apparatus, that no recording sheet bundle to which the adhesive has not been applied within the bookbinding apparatus exists, said control unit controls said stirring unit to stir the adhesive over a first time period, and when said determination unit determines, at the power-on of the bookbinding apparatus, that a recording sheet bundle to which the adhesive has not been applied within the bookbinding apparatus exists, said control unit controls said stirring unit to stir the adhesive over a second time period shorter than the first time period.

3. The bookbinding apparatus according to claim 1, further comprising:

a stacking unit configured to stack the recording sheet bundle to be subjected to application of the adhesive; and a storage unit configured to store status data representing operational statuses of the bookbinding apparatus including at least one of a status of stacking of the recording sheet bundle on said stacking unit and a status of application of the adhesive to the recording sheet bundle by said adhesive applying unit, wherein at the power-on of the bookbinding apparatus, said determination unit determines, based on the status data stored in said storage unit, whether or not a recording sheet bundle to which the adhesive has not been applied within the bookbinding apparatus exists.

4. The bookbinding apparatus according to claim 1, further comprising:

a cover sheet sticking unit configured to stick the cover sheet to the recording sheet bundle having the adhesive applied thereto by said adhesive applying unit, wherein when said determination unit determines, at the power-on of the bookbinding apparatus, that a recording sheet bundle to which the adhesive has not been applied within the bookbinding apparatus exists, said control unit controls said adhesive applying unit to apply the adhesive to the recording sheet bundle and then discharges the recording sheet bundle without causing said cover sheet sticking unit to stick the cover sheet to the recording sheet bundle.

5. An image forming apparatus having a bookbinding apparatus connected thereto and delivers a recording sheet having an image formed thereon to the bookbinding apparatus, wherein the bookbinding apparatus comprises:

a heating unit configured to heat an adhesive;

a temperature detecting unit configured to detect a temperature of the adhesive;

an adhesive applying unit configured to apply the adhesive heated by said heating unit to an end of the recording sheet bundle;

a determination unit configured to determine, at power-on of the bookbinding apparatus, whether or not any recording sheet bundle to which the adhesive has not been applied within the bookbinding apparatus exists; and a control unit configured to:

when said determination unit determines, at the power-on of the bookbinding apparatus, that no recording sheet bundle to which the adhesive has not been applied within the bookbinding apparatus exists, control said adhesive applying unit to apply the adhesive to a recording sheet bundle after said temperature detecting unit detects that the temperature of the adhesive has reached a first temperature; and when said determination unit determines, at the power-on of the bookbinding apparatus, that a recording sheet bundle to which the adhesive has not been applied within the bookbinding apparatus exists, control said adhesive applying unit to apply the adhesive to the recording sheet bundle after said temperature detecting unit detects that the temperature of the adhesive has reached a second temperature, which is lower than the first temperature.

6. A method of controlling a bookbinding apparatus for performing bookbinding processing by applying an adhesive to an end of a recording sheet bundle and sticking a cover sheet to the end of the recording sheet bundle, wherein the bookbinding apparatus comprises:

a heating unit configured to heat the adhesive;

a temperature detecting unit configured to detect a temperature of the adhesive;

an adhesive applying unit configured to apply the adhesive heated by the heating unit to the end of the recording sheet bundle;

a determination unit configured to determine, at power-on of the bookbinding apparatus, whether or not any recording sheet bundle to which the adhesive has not been applied within the bookbinding apparatus exists; and a control unit configured to control the adhesive applying unit to apply the adhesive to the recording sheet bundle, wherein the method comprises the steps of:

when the determination unit determines, at the power-on of the bookbinding apparatus, that no recording sheet bundle to which the adhesive has not been applied within the bookbinding apparatus exists controlling, with the control unit, the adhesive applying unit to apply the adhesive to a recording sheet bundle after the temperature detecting unit detects that the temperature of the adhesive has reached a first temperature; and when the determination unit determines, at the power-on of the booking binding apparatus, that a recording sheet bundle to which the adhesive has not been applied within the bookbinding apparatus exists controlling, with the control unit, the adhesive applying unit to apply the adhesive to the recording sheet bundle after the temperature of the adhesive reaches a second temperature, which is lower than the first temperature.

7. A bookbinding apparatus for performing a bookbinding processing by applying an adhesive to an end of a recording sheet bundle and sticking a cover sheet to the end of the recording sheet bundle, the bookbinding apparatus comprising:

a heating unit configured to heat the adhesive;

a temperature detecting unit configured to detect a temperature of the adhesive;

an adhesive applying unit configured to apply the adhesive heated by said heating unit to the end of the recording sheet bundle;

a determination unit configured to determine, at power-on of the bookbinding apparatus, whether or not any recording sheet bundle for which the bookbinding processing is not completed and to which the adhesive has not been applied exists; and a control unit configured to:

when said determination unit determines, at the power-on of the bookbinding apparatus, that no recording sheet bundle for which the bookbinding processing is not completed and to which the adhesive has not been applied exists, cause said adhesive applying unit to apply the adhesive to a recording sheet bundle after said temperature detecting unit detects that the temperature of the adhesive has reached a first temperature; and when said determination unit determines, at the power-on of the bookbinding apparatus, that a recording sheet bundle for which the bookbinding processing is not completed and to which the adhesive has not been applied exists, cause said adhesive applying unit to apply the adhesive to the recording sheet bundle after said temperature detecting unit detects that the temperature of the adhesive has reached a second temperature, which is lower than the first temperature.

8. An image forming apparatus having a bookbinding apparatus connect thereto and delivers a recording sheet having an image formed thereon to the bookbinding apparatus, wherein the bookbinding apparatus comprises:

a heating unit configured to heat the adhesive;

a temperature detecting unit configured to detect a temperature of the adhesive;

an adhesive applying unit configured to apply the adhesive heated by said heating unit to an end of the recording sheet bundle;

a determination unit configured to determine, at power-on of the bookbinding apparatus, whether or not any recording sheet bundle for which the bookbinding processing is not completed and to which the adhesive has not been applied exists; and a control unit configured to:

when said determination unit determines, at the power-on of the bookbinding apparatus, that no recording sheet bundle for which the bookbinding processing is not completed and to which the adhesive has not been applied exists, control said adhesive applying unit to apply the adhesive to a recording sheet bundle after said temperature detecting unit detects that the temperature of the adhesive has reached a first temperature; and when said determination unit determines, at the power-on of the bookbinding apparatus, that a recording sheet bundle for which the bookbinding processing is not completed and to which the adhesive has not been applied exists, control said adhesive applying unit to apply the adhesive to the recording sheet bundle after said temperature detecting unit detects that the temperature of the adhesive has reached a second temperature, which is lower than the first temperature.

9. A method of controlling a bookbinding apparatus for performing bookbinding processing by applying an adhesive to an end of a recording sheet bundle and sticking a cover sheet to the end of the recording sheet bundle, wherein the bookbinding apparatus comprises:

a heating unit configured to heat the adhesive;

a temperature detecting unit configured to detect a temperature of the adhesive;

an adhesive applying unit configured to apply the adhesive heated by the heating unit to the end of the recording sheet bundle;

a determination unit configured to determine, at power-on of the bookbinding apparatus, whether or not any recording sheet bundle for which the bookbinding processing is not completed and to which the adhesive has not been applied exists; and a control unit configured to control the adhesive applying unit to apply the adhesive to the recording sheet bundle, wherein the method comprises the steps of:

when the determination unit determines, at the power-on of the bookbinding apparatus, that no recording sheet bundle for which the bookbinding processing is not completed and to which the adhesive has not been applied exists, controlling, with the control unit, the adhesive applying unit to apply the adhesive to a recording sheet bundle after the temperature detecting unit detects that the temperature of the adhesive has reached a first temperature; and when the determination unit determines, at the power-on of the bookbinding apparatus, that a recording sheet bundle for which the bookbinding processing is not completed and to which the adhesive has not been applied exists, controlling, with the control unit, the adhesive applying unit to apply the adhesive to the recording sheet bundle after the temperature of the adhesive reaches a second temperature, which is lower than the first temperature.

* * * * *